US010738553B2

(12) United States Patent
Wiercigroch et al.

(10) Patent No.: US 10,738,553 B2
(45) Date of Patent: Aug. 11, 2020

(54) RESONANCE ENHANCED ROTARY DRILLING ACTUATOR

(71) Applicant: ITI Scotland Limited, Glasgow (GB)

(72) Inventors: Marian Wiercigroch, Aberdeen (GB); Marcin Kapitaniak, Aberdeen (GB); Seyed Vahid Vaziri Hamaneh, Aberdeen (GB); Nina Yari, Aberdeen (GB)

(73) Assignee: ITI Scotland Limited, Glasgow (GB)

( * ) Notice: Subject to any disclaimer, the term of this patent is extended or adjusted under 35 U.S.C. 154(b) by 173 days.

(21) Appl. No.: 15/557,048

(22) PCT Filed: Mar. 11, 2016

(86) PCT No.: PCT/EP2016/055357
§ 371 (c)(1),
(2) Date: Sep. 8, 2017

(87) PCT Pub. No.: WO2016/142537
PCT Pub. Date: Sep. 15, 2016

(65) Prior Publication Data

US 2018/0066488 A1 Mar. 8, 2018

(30) Foreign Application Priority Data

Mar. 11, 2015 (GB) ..... 1504106.4

(51) Int. Cl.
*E21B 7/24* (2006.01)
*E21B 28/00* (2006.01)
(Continued)

(52) U.S. Cl.
CPC ..... *E21B 28/00* (2013.01); *B06B 1/10* (2013.01); *B06B 1/12* (2013.01); *E21B 7/24* (2013.01)

(58) Field of Classification Search
CPC ..... E21B 7/04; E21B 7/24; E21B 3/025
(Continued)

(56) References Cited

U.S. PATENT DOCUMENTS 1,041,569 A 10/1912 Bade
1,196,656 A 8/1916 Bugbee
(Continued)

FOREIGN PATENT DOCUMENTS

CN 1628207 A 6/2005
CN 102287137 A 12/2011
(Continued)

OTHER PUBLICATIONS

Neil Sclater, "Mechanisms and Mechanical Devices Sourcebook", Fifth Edition, pp. 14-17 and 188-189.
(Continued)

*Primary Examiner* — Kenneth L Thompson
(74) *Attorney, Agent, or Firm* — Gavrilovich, Dodd & Lindsey LLP

(57) ABSTRACT

Provided is a device for converting rotary motion into oscillatory axial motion, which device comprises:
(a) a rotation element (1);
(b) a base element (2); and
(c) one or more bearings (3) for facilitating rotary motion of the rotation element relative to the base element;
wherein the rotation element and/or the base element comprise one or more raised portions (4) and/or one or more lowered portions (5) over which portions the one or more bearings (3) pass in order to periodically increase and decrease axial distance between the rotation element (1) and the base element (2) as rotation occurs, thereby imparting an oscillatory axial motion to the rotation element (1) relative to the base element (2).

26 Claims, 22 Drawing Sheets

(51) Int. Cl.
*B06B 1/10* (2006.01)
*B06B 1/12* (2006.01)

(58) Field of Classification Search
USPC ..... 175/56; 166/249
See application file for complete search history.

(56) References Cited

U.S. PATENT DOCUMENTS

| | | | | |
|---|---|---|---|---|
| 2,495,364 | A * | 1/1950 | Clapp | E21B 4/10 175/195 |
| 2,607,568 | A | 8/1952 | Seavey et al. | |
| 2,742,265 | A | 4/1956 | Snyder | |
| 2,770,974 | A | 11/1956 | Werner | |
| 3,235,014 | A * | 2/1966 | Brooks | E21B 3/02 173/197 |
| 3,268,014 | A * | 8/1966 | Drew | B25D 11/102 173/97 |
| 3,659,464 | A | 5/1972 | Puyo et al. | |
| 3,990,522 | A | 11/1976 | Pyles et al. | |
| 4,253,531 | A * | 3/1981 | Boros | E21B 4/10 175/106 |
| 5,116,147 | A | 5/1992 | Pajari, Sr. | |
| 7,191,848 | B2 * | 3/2007 | Ha | B25D 11/104 173/109 |
| 8,517,093 | B1 | 8/2013 | Benson | |
| 8,739,901 | B2 | 6/2014 | Cote | |
| 9,500,031 | B2 * | 11/2016 | Coull | E21B 7/04 |
| 9,624,725 | B2 | 4/2017 | Cote | |
| 2006/0157280 | A1 | 7/2006 | Fincher et al. | |
| 2010/0003096 | A1 | 1/2010 | Peigne | |
| 2016/0053545 | A1 * | 2/2016 | Holtz | E21B 7/24 175/50 |
| 2018/0080284 | A1 * | 3/2018 | Prill | E21B 7/24 |

FOREIGN PATENT DOCUMENTS

| | | | |
|---|---|---|---|
| CN | 102926662 | A | 2/2013 |
| CN | 103502555 | A | 1/2014 |
| CN | 103703209 | A | 4/2014 |
| WO | 2007141550 | A1 | 12/2007 |
| WO | 2011/0328744 | A1 | 3/2011 |
| WO | 2012076401 | A2 | 6/2012 |

OTHER PUBLICATIONS

Ellis, Lyndon, Search Report, Great Britain Patent Office, Application No. GB1504106.4, dated Jun. 2, 2015.

Wang, Xiaodong, First Office Action and Search Report, China National Intellectual Property Administration, Application No. 201680014592.X, dated Jun. 5, 2019.

Fedorova, T.V., Office Action, Russian Patent Office, Application No. 2017134970, Aug. 15, 2019.

Orlov P.I. Design Basics: Reference and Methodological Manual. B. 2, under the editorship of P.N. Uchaev. 3rd ed., Revised, Moscow, "Machine Building", 1988, pp. 405-406.

* cited by examiner

RESONANCE ENHANCED ROTARY DRILLING ACTUATOR

CROSS REFERENCE TO RELATED APPLICATIONS

This application is a U.S. National Stage Application filed under 35 U.S.C. § 371 and claims priority to International Application No. PCT/EP2016/055357, filed Mar. 11, 2016, which application claims priority to Great Britain Application No. 1504106.4, filed Mar. 11, 2015, the disclosures of which are incorporated herein by reference.

The present invention relates to high frequency percussion enhanced rotary drilling, and in particular to Resonance Enhanced Drilling. Embodiments of the invention are directed to a device for converting rotary motion into linear motion, an actuator (e.g. a linear actuator) incorporating the device, and apparatus and methods for resonance enhanced rotary drilling incorporating and employing the device in order to improve drilling performance. Further embodiments of this invention are directed to resonance enhanced drilling equipment which may be controllable according to these methods and apparatus. Certain embodiments of the invention are applicable to any size of drill or material to be drilled. Certain more specific embodiments are directed at drilling through rock formations, particularly those of variable composition, which may be encountered in deep-hole drilling applications in the oil, gas mining and construction industries.

Percussion enhanced rotary drilling is known per se. A percussion enhanced rotary drill comprises a rotary drill-bit and an actuator or oscillator for applying impact loading to the rotary drill-bit with low frequency and with a limited control of the impact force. The actuator provides impact forces on the material being drilled so as to break up the material which aids the rotary drill-bit in cutting though the material.

Resonance Enhanced Rotary Drilling is a special type of percussion enhanced rotary drilling in which the oscillations are generated at resonance and at high frequency so as to achieve penetration rate enhancement of the material being drilled. This results in an amplification of the dynamic stress exerted at the rotary drill-bit thus increasing drilling efficiency when compared to standard percussion enhanced rotary drilling.

U.S. Pat. No. 3,990,522 discloses a percussion enhanced rotary drill which uses a hydraulic hammer mounted in a rotary drill for drilling bolt holes. It is disclosed that an impacting cycle of variable stroke and frequency can be applied and adjusted to the natural frequency of the material being drilled to produce an amplification of the pressure exerted at the tip of the drill-bit. A servovalve maintains percussion control, and in turn, is controlled by an operator through an electronic control module connected to the servovalve by an electric conductor.

The operator can selectively vary the percussion frequency from 0 to 2500 cycles per minute (i.e. 0 to 42 Hz) and selectively vary the stroke of the drill-bit from 0 to ⅛ inch (i.e. 0 to 3.175 mm) by controlling the flow of pressurized fluid to and from an actuator. It is described that by selecting a percussion stroke having a frequency that is equal to the natural or resonant frequency of the rock strata being drilled, the energy stored in the rock strata by the percussion forces will result in amplification of the pressure exerted at the tip of the drill-bit such that the solid material will collapse and dislodge and permit drill rates in the range 3 to 4 feet per minute.

There are several problems which have been identified with the aforementioned arrangement and which are discussed below.

High frequencies are not attainable using the apparatus of U.S. Pat. No. 3,990,522 which uses a relatively low frequency hydraulic oscillator. Accordingly, although U.S. Pat. No. 3,990,522 discusses the possibility of resonance, it would appear that the low frequencies attainable by its oscillator are insufficient to achieve enhanced drilling penetration through many hard materials. Moreover, there is no mention what would constitute the oscillator.

Regardless of the frequency issue discussed above, resonance cannot easily be achieved and maintained in any case using the arrangement of U.S. Pat. No. 3,990,522, particularly if the drill passes through different materials having different resonance characteristics. This is because control of the percussive frequency and stroke in the arrangement of U.S. Pat. No. 3,990,522 is achieved manually by an operator. As such, it is difficult to control the apparatus to continuously adjust the frequency and stroke of percussion forces to maintain resonance as the drill passes through materials of differing type. This may not be such a major problem for drilling shallow bolt holes as described in U.S. Pat. No. 3,990,522. An operator can merely select a suitable frequency and stroke for the material in which a bolt hole is to be drilled and then operate the drill. However, the problem is exacerbated for deep-drilling through many different layers of rock. An operator located above a deep-drilled hole cannot see what type of rock is being drilled through and cannot readily achieve and maintain resonance as the drill passes from one rock type to another, particularly in regions where the rock type changes frequently.

Some of the aforementioned problems have been solved by the present inventor as described in WO 2007/141550. WO 2007/141550 describes a resonance enhanced rotary drill comprising an automated feedback and control mechanism which can continuously adjust the frequency and stroke of percussion forces to maintain resonance as a drill passes through rocks of differing type. The drill is provided with an adjustment means which is responsive to conditions of the material through which the drill is passing and a control means in a downhole location which includes sensors for taking downhole measurements of material characteristics whereby the apparatus is operable downhole under closed loop real-time control.

US2006/0157280 suggests down-hole closed loop real-time control of an oscillator. It is described that sensors and a control unit can initially sweep a range of frequencies while monitoring a key drilling efficiency parameter such as rate of progression (ROP). An oscillation device can then be controlled to provide oscillations at an optimum frequency until the next frequency sweep is conducted. The pattern of the frequency sweep can be based on a one or more elements of the drilling operation such as a change in formation, a change in measured ROP, a predetermined time period or instruction from the surface. The detailed embodiment utilises an oscillation device which applies torsional oscillation to the rotary drill-bit and torsional resonance is referred to. However, it is further described that exemplary directions of oscillation applied to the drill-bit include oscillations across all degrees-of-freedom and are not utilised in order to initiate cracks in the material to be drilled. Rather, it is described that rotation of the drill-bit causes initial fractioning of the material to be drilled and then a momentary oscillation is applied in order to ensure that the rotary drill-bit remains in contact with the fracturing material. There does not appear to be any disclosure or suggestion of providing an actuator or oscillator which can import sufficiently high axial oscillatory loading to the drill-bit in order to initiate cracks in the material through which the rotary drill-bit is passing as is required in accordance with resonance enhanced drilling as described in WO 2007/141550.

None of the prior art provides any detail about how to monitor axial oscillations. Sensors are disclosed generally in the US2006/0157280 and in WO 2007/141550 but the positions of these sensors relative to components such as a vibration isolation unit and a vibration transmission unit is not discussed.

Despite the solutions described in the prior art, there has been a desire to make further improvements to the methods and apparatus it describes. It is an aim of embodiments of the present invention to make such improvements in order to increase drilling efficiency, increase drilling speed and borehole stability and quality, while limiting wear and tear on the apparatus so as to increase the lifetime of the apparatus. It is a further aim to more precisely control resonance enhanced drilling, particularly when drilling through rapidly changing rock types.

It is a particular focus of the present invention to provide an improved mechanical actuator for converting rotary motion into oscillations along the axis of rotation. Such oscillatory axial motion is an essential feature of resonance enhanced drilling. Whilst the prior art, and WO 2007/141550 in particular, employ actuators of various types, these are not actuators that have been designed for resonance enhanced drilling, but rather are "off the shelf" components. Although these are satisfactory for the purpose, they are not ideal and an improved actuator specifically designed for resonance enhanced drilling is still desired.

Earlier patent applications of the present inventor have described RED modules comprising "off the shelf" actuators, for example in WO 2012/076401. However, in the art, there is no information about how to design an actuator specifically adapted to resonance enhanced drilling.

It is an aim of the present invention to solve the problems associated with the prior art, as highlighted above. In particular, it is an aim of the present invention to provide a device for converting rotational motion into oscillatory axial motion, which device may be employed in an actuator (a linear actuator) for use in resonance enhanced drilling. It is also an aim to provide an apparatus for resonance enhanced drilling comprising the device and actuator of the invention, and methods of drilling employing the device and actuator of the invention.

Accordingly, the present invention provides a device for converting rotary motion into oscillatory axial motion, which device comprises:

(a) a rotation element (1);

(b) a base element (2); and (c) one or more bearings (3) for facilitating rotary motion of the rotation element relative to the base element;

wherein the rotation element and/or the base element comprise one or more raised portions (4) and/or one or more lowered portions (5) over which portions the one or more bearings (3) pass in order to periodically increase and decrease axial distance between the rotation element (1) and the base element (2) as rotation occurs, thereby imparting an oscillatory axial motion to the rotation element (1) relative to the base element (2).

In the present context, axial motion refers to a component of motion parallel to the axis of rotation of the rotary motion. Typically the rotary motion is provided by the rotary drilling motion in the context of resonance enhanced drilling.

It is envisaged that this device may be employed in an actuator which may in turn be employed in a resonance enhanced drilling module in a drill-string. The drill-string configuration is not especially limited, and any configuration may be envisaged, including known configurations. The module may be turned on or off as and when resonance enhancement is required.

The one or more bearings employed in the device are not especially limited provided that they serve to facilitate the relative rotatory motion between the rotation element and the base element. Typically the bearings, although interacting with the rotation and the base elements to impart oscillatory axial motion, do not pass on torque from the rotatory motion. Advantageously, the one or more bearings may selected from a fluid bearing (such as a hydraulic bearing (liquid) or a pneumatic bearing (gas), a plain bearing, a rolling-element bearing (such as ball bearings and/or roller bearings and/or barrel bearings), a magnetic bearing, a jewel bearing and a flexure bearing. In downhole drilling applications, rolling element bearings are preferably used. FIG. 1 shows an embodiment employing ball bearings (3).

The raised and or lowered portions are designed to interact with the one or more bearings in order to transform the rotary motion into oscillatory axial motion. The form of the raised or lowered portions is not especially limited provided that this function is not impaired.

In one embodiment, the raised and/or lowered portions are only present on one of the elements (either the rotation element or the base element) whilst the other element does not possess raised or lowered portions (i.e. is typically planar or flat). In this way the axial distance between the elements can be varied as rotation occurs. In this embodiment, the amplitude of oscillation provided by the device depends on the difference between the raised and/or lowered portions as measured along the axial direction.

In a preferred embodiment there may be raised and/or lowered portions on both elements (both the rotation element and the base element). In this embodiment, the amplitude of oscillation provided by the device depends on the sum of the differences between the raised and/or lowered portions as measured along the axial direction.

Rolling-element bearings are preferred, as they reduce or eliminate slipping between the surfaces of the bearing and the rotation element and the base element, and in doing so, advantageously minimise friction between the bearing and the rotation element and the base element.

Thus, the raised or lowered portions may be in the form of indentations and/or protuberances set into the rotation element and/or into the base element. Typically, but not exclusively, the indentations and/or protuberances may be in the form of ridges (4) and troughs (5) running radially out from the axis of rotation of the rotation element and/or of the base element. Preferably, the raised and/or lowered portions may be in the form of regular, periodic changes in the thickness of the rotation element and/or of the base element, in order to provide regular, periodic axial motion. Preferably in order to reduce stress and improve the life of the device, the raised and or lowered portions may be in the form of smooth changes in the thickness of the rotation element and/or of the base element. Preferably, the raised or lowered portions are arranged in a sinusoidal pattern in the circumferential or tangential direction. The surface(s) of the rotation element and/or the base element may therefore provide the one or more bearings passing thereover with an oscillatory motion in the axial direction in a sinusoidal, or periodic, pattern around the tangent/circumference of the rotation element and/or the base element.

In some embodiments, the raised and or lowered portions may be in the form of a track or groove set into the rotation element and/or into the base element, wherein the track or groove is configured to constrain the one or more bearings. In a preferred embodiment, when the one or more bearings are one or more ball bearings, the track or groove may have a tangential cross-section in the shape of an arc. In a particularly preferred embodiment, the tangential cross-section is in the shape of a circular arc. It will be appreciated that when the tangential cross-section is in the shape of a circular arc, and when viewed along the axis, the track or groove is constricted in width and depth at regular intervals, thereby providing a reduced cross-section area. In this embodiment, the groove or track may be said to harmonic or periodic around the circumferential or tangential direction when viewed along the axis. These embodiments reduce slippage between the surfaces of one or more bearings with the rotation element and/or the base element.

The amplitude of oscillation provided by the device may range from 0.1 mm to 5 mm, preferably 0.2 to 4 mm, more preferably 0.4 to 3 mm, more preferably 0.5 to 2 mm, more preferably 0.7 mm to 1.5 mm, and more preferably 0.8 mm to 1.2 mm. A preferred amplitude is 1 mm.

The rotation element and the base element are not especially limited, provided that the function of the device is not impaired. Typically the rotation element and/or the base element are in the form of a disc or annulus within which the raised and/or lowered portions are set. Typically, both the rotation and base elements are in the form of an annulus into which a track or groove is set having a smooth set of "hills and valleys" which form the raised and lowered portions (see FIG. 1) and along which the bearings are constrained to move.

In an embodiment, the device further comprises a spring. The spring may urge the rotation element and the base element together. The spring may be a toroidal unit with a concertina-shaped wall, preferably a hollow metal can with a concertina-shaped wall. The spring may, for instance, be a disc spring or a Belleville washer.

In an embodiment, where rolling-element bearings are used, the device further may comprise a bearing cage. The bearing cage may be used to ensure the angular positions of each rolling-element bearing relative to another rolling-element bearing do not shift.

The present invention also provides an actuator for use in a resonance enhanced drilling module comprising a device as defined above.

The present invention further provides apparatus for use in resonance enhanced rotary drilling, which apparatus comprises a device or an actuator as defined above.

Typically the apparatus comprises:

(i) a sensor for measuring static loading or for monitoring the compressive strength of the material being drilled;
(ii) a vibration isolation unit;
(iii) a device or actuator as defined above, for applying axial oscillatory loading to the rotary drill-bit;
(iv) a sensor for measuring dynamic axial loading or for monitoring the compressive strength of the material being drilled;
(v) a drill-bit connector; and
(vi) a drill-bit, wherein the sensor (i) is preferably positioned above the vibration isolation unit and the sensor (iv) is preferably positioned between the device or actuator and the drill-bit connector (v) wherein the sensors are connected to a controller in order to provide down-hole closed loop real time control of the device or actuator (iii).

The sensors are not especially limited, provided that they are capable of performing the required measurements. In typical embodiments sensor (i) and/or sensor (iv) may comprise a load cell.

Typically, the apparatus further comprises a vibration transmission unit between device or actuator (iii) and sensor (iv). Further typically, the vibration isolation unit and/or the vibration transmission unit comprises a structural spring. The structural spring may be, for example, a toroidal unit with a concertina-shaped wall, preferably a hollow metal can with a concertina-shaped wall. The structural spring may, for instance, be a disc spring or a Belleville washer. In an embodiment, the vibration transmission unit increases the amplitude of vibration provided by the device. In an embodiment, the vibration transmission unit increases the amplitude of vibration to provide an amplitude in the range of 0.5 to 10 mm, preferably 1 to 10 mm, more preferably 1 to 5 mm, and more preferably 1 to 3 mm. Alternatively, the vibration transmission unit increases the amplitude of vibration to provide an amplitude of at least 10 mm, preferably at least 5 mm, more preferably at least 3 mm or more preferably at least 1 mm.

In this arrangement, the positioning of the upper sensor (e.g. a load-cell) is typically such that the static axial loading from the drill string can be measured. The position of the lower sensor (e.g. a load-cell) is typically such that dynamic loading passing from the device or actuator through the vibration transmission unit to the drill-bit can be measured. The order of the components of the apparatus of this embodiment is particularly preferred to be from (i)-(viii) above from the top down.

It is envisaged that this apparatus may be employed as a resonance enhanced drilling module in a drill-string. The drill-string configuration is not especially limited, and any configuration may be envisaged, including known configurations. The module may be turned on or off as and when resonance enhancement is required.

The apparatus gives rise to a number of advantages. These include: increased drilling speed; better borehole stability and quality; less stress on apparatus leading to longer lifetimes; provision of oscillations having higher force and/or frequency; improved robustness, in particular by virtue of the exclusive use of the mechanical components in the device; and greater efficiency reducing energy costs.

The preferred applications are in large scale drilling apparatus, control equipment and methods of drilling for the oil and gas industry. However, other drilling applications may also benefit, including: surface drilling equipment, control equipment and methods of drilling for road contractors; drilling equipment, control equipment and method of drilling for the mining industry; hand held drilling equipment for home use and the like; specialist drilling, e.g. dentist drills.

The invention will now be described in more detail by way of example only, with reference to the following Figures, in which.

Figure 8:
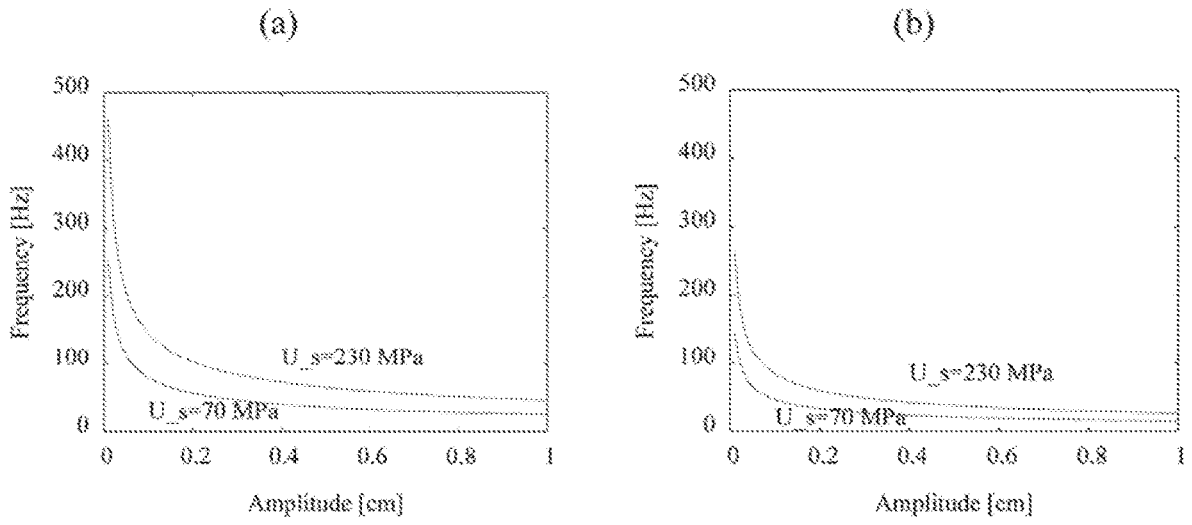
Figure 9:
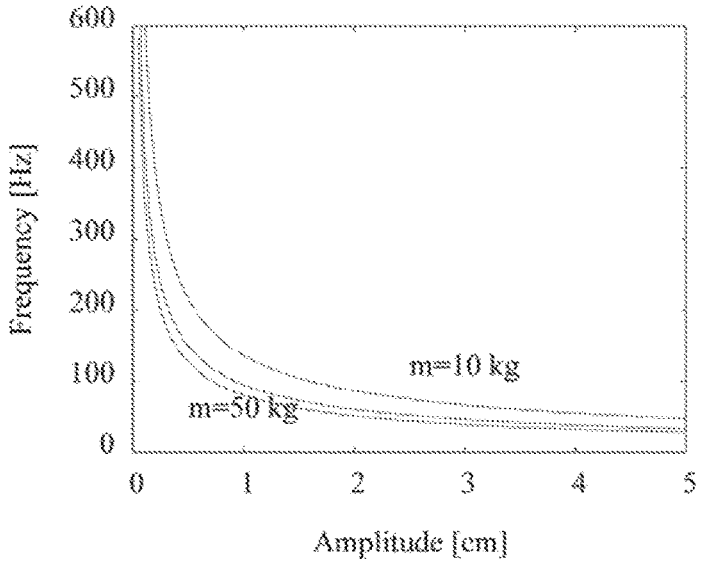
Figure 10:
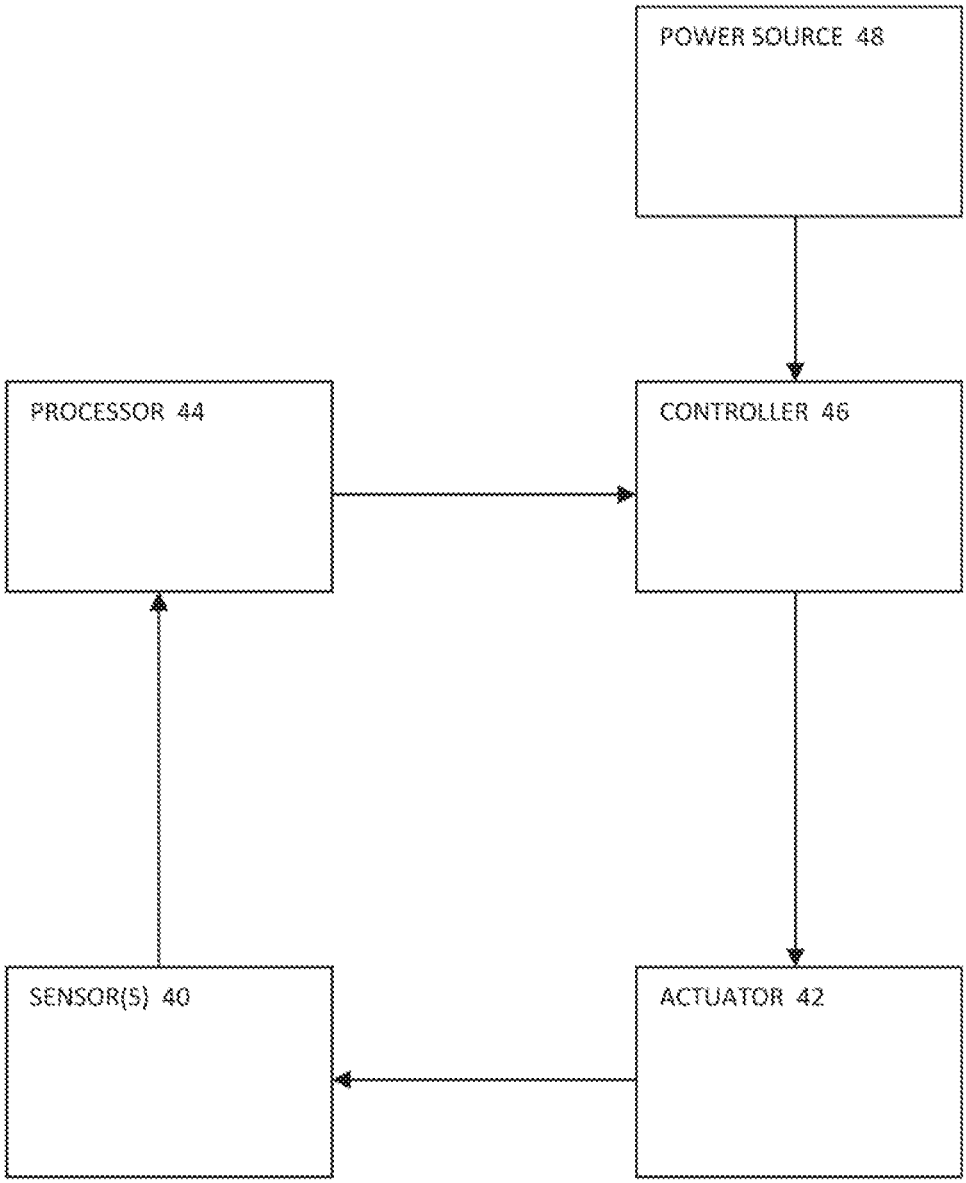

FIGS. 8(*a*) and (*b*) show graphs illustrating necessary minimum frequency as a function of vibration amplitude for a drill-bit having a diameter of 150 mm;

FIG. 9 shows a graph illustrating maximum applicable frequency as a function of vibration amplitude for various vibrational masses given a fixed power supply; and FIG. 10 shows a schematic diagram illustrating a downhole closed loop real-time feedback mechanism.

Figure 11:
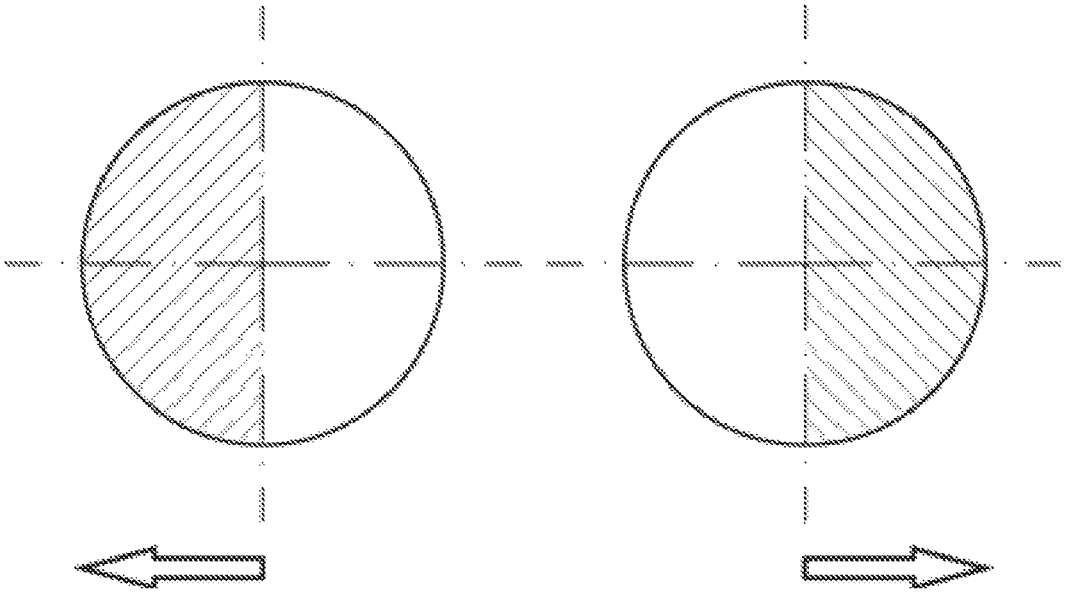

FIG. 11 shows activation zones for steering in different directions in the directional drilling aspect of the invention. The longitudinal force from the steering actuators, or the preferential drilling from the steering inserts, will cause one side of the drilling zone to be preferentially drilled.

Figure 12:
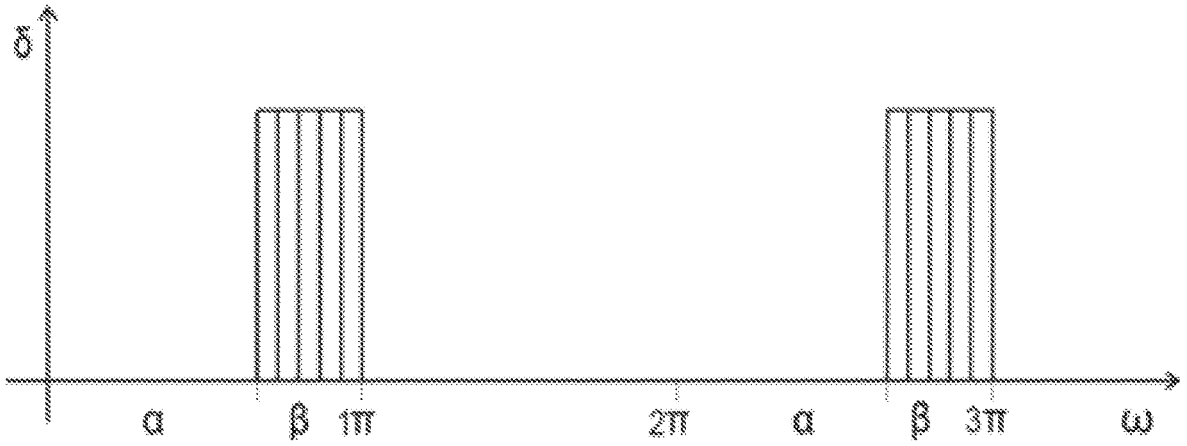

FIG. 12 shows an electronic activation impulse that may be sent to a steering insert in order to control extension of the insert at a required angle of rotation.

Figure 13:
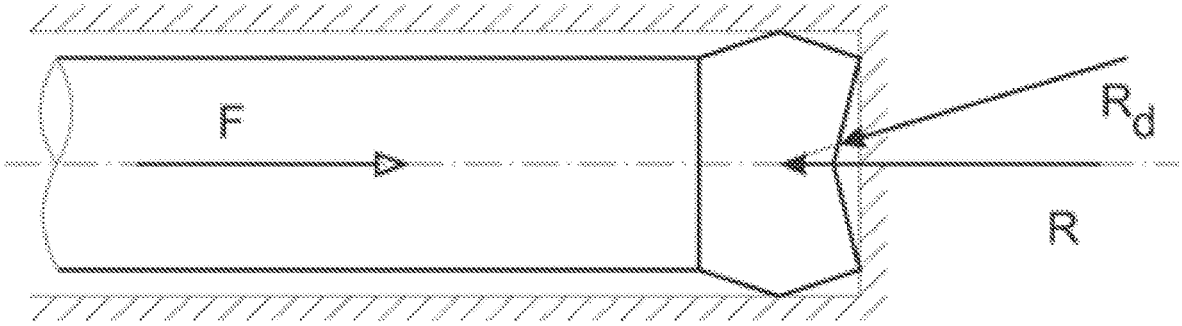

FIG. 13 shows forces on the drill-bit (F—weight-on-bit force, R—reaction force, Rd—effective reaction force after the application of the RED impulse control).

Figure 14:
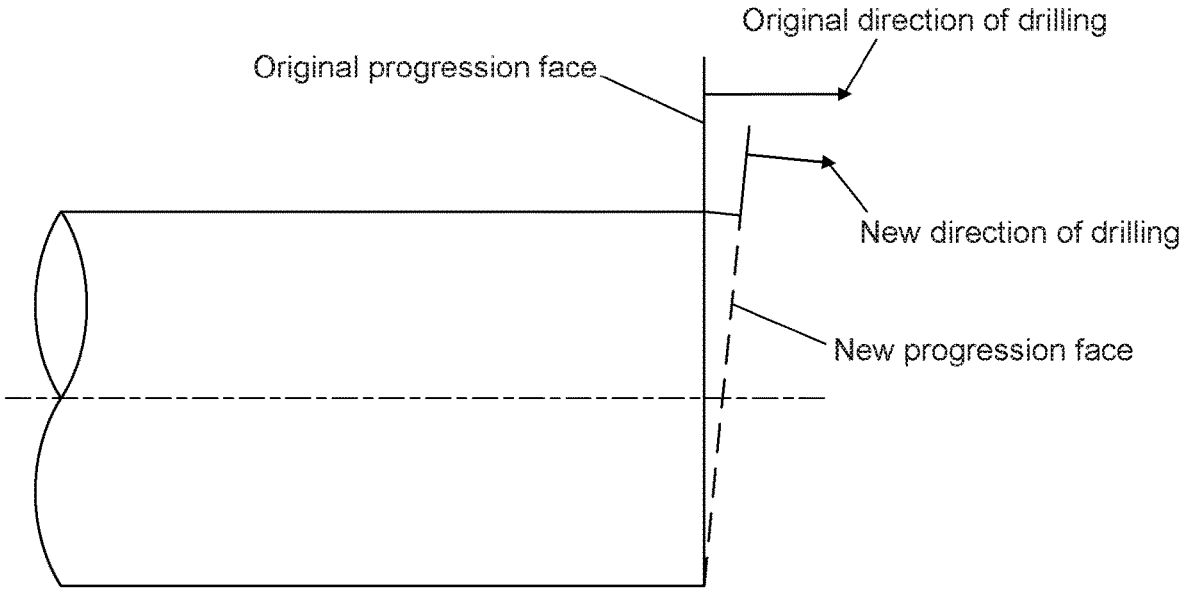

FIG. 14 shows the change of drilling direction after applying the activation impulse.

Figure 15:
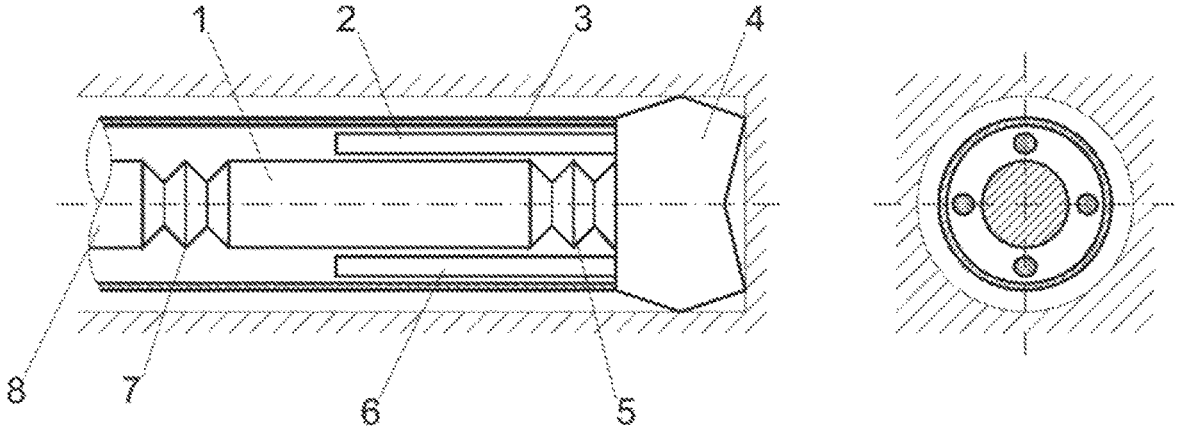

FIG. 15 shows a conceptual representation of an apparatus of the invention with one main (RED) actuator and four additional steering actuators (1—main actuator, 2—additional steering actuator, 3—external casing of the apparatus, 4—drill-bit, 5—RED vibration enhancer spring, 6—additional steering actuator, 7—RED vibration isolator spring, 8—connection with the drill-string) with a cross-section.

Figure 16:
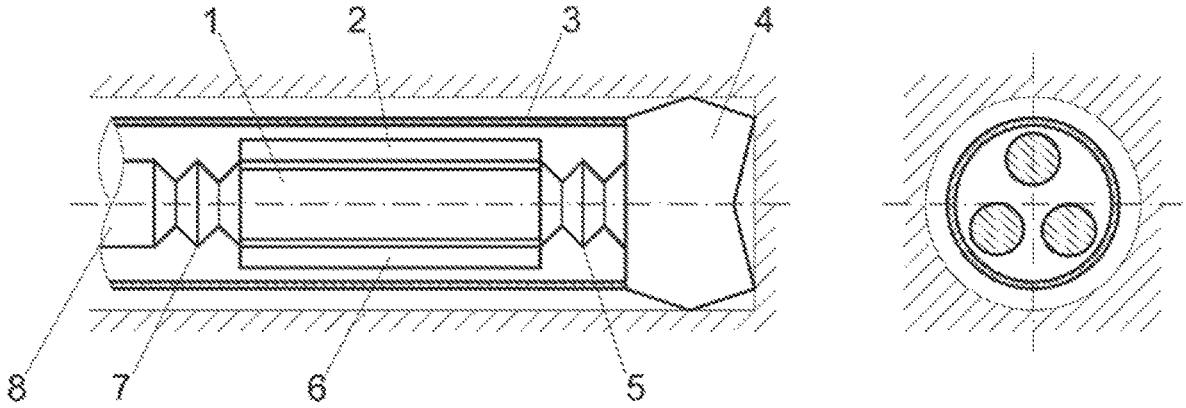

FIG. 16 shows a conceptual representation of an apparatus of the invention with three equivalent actuators acting as steering actuators and also as RED actuators instead of a main actuator (1—acutator, 2—actuator, 3—external casing of the apparatus, 4—drill-bit, 5—RED vibration enhancer spring, 6—actuator, 7—RED vibration isolator spring, 8—connection with the drill-string) with a cross-section.

Figure 17:
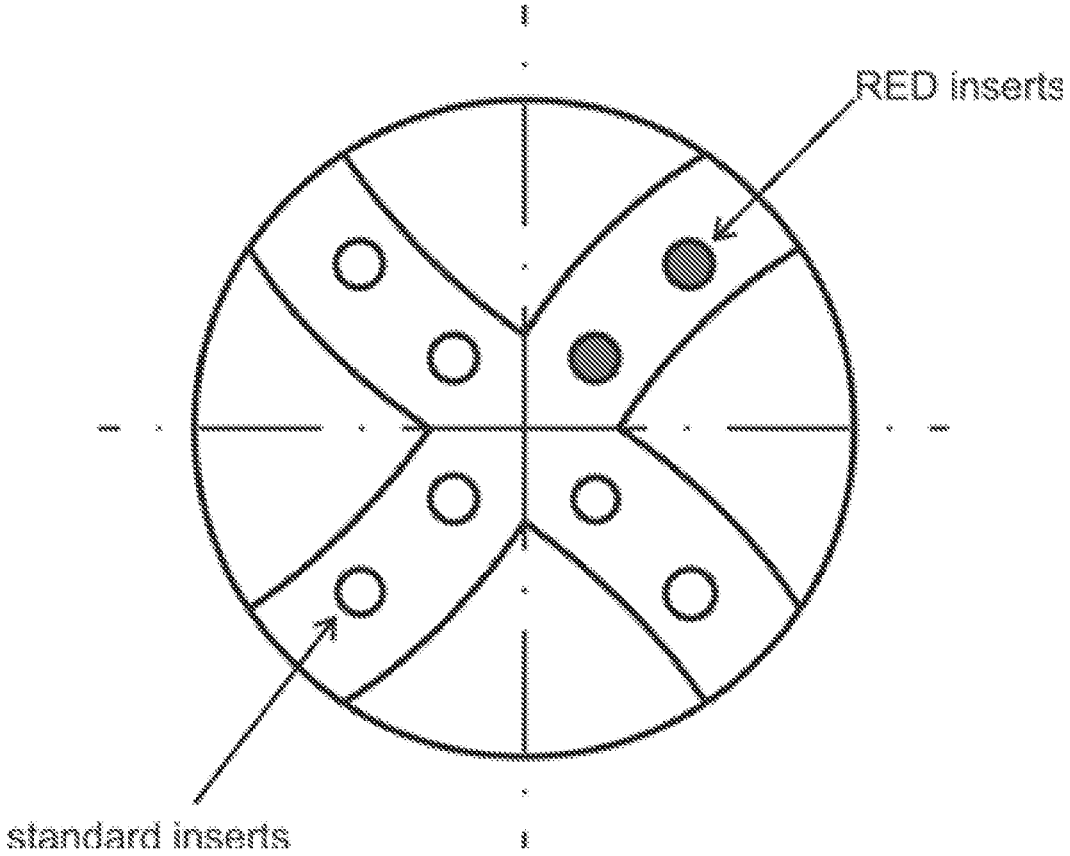

FIG. 17 shows a simplified representation of the bottom of the drill-bit with a combination of steering inserts (termed RED inserts in the Figure) and standard inserts.

Figure 18:
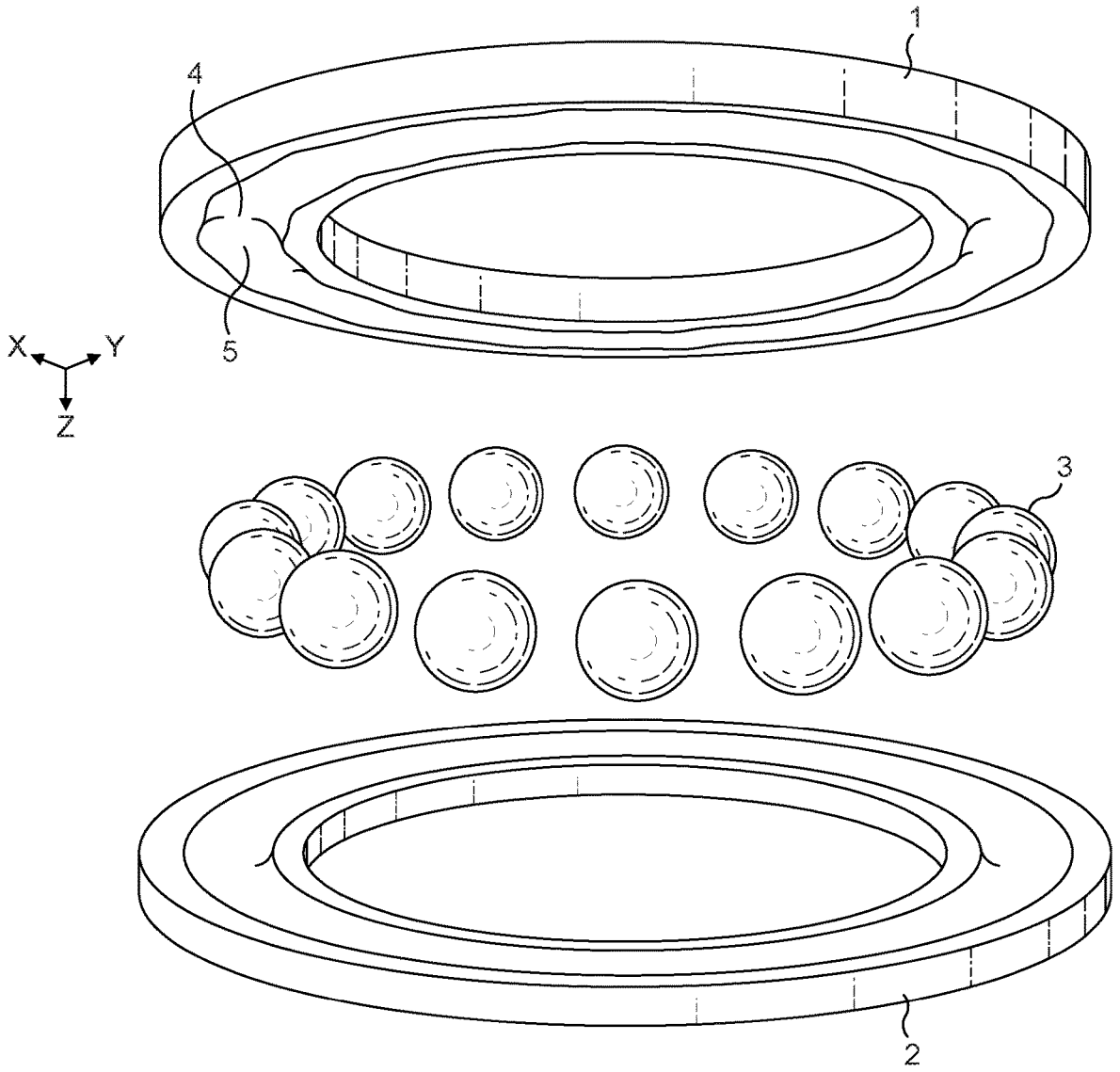

FIG. 18 shows the device of the invention, including the rotation element (1), the base element (2), the one or more bearings (3), the raised portions (4) and the lowered portions (5), in which the raised and lowered portions are present as a "groovy track" set into the rotation element. The track or groove has a tangential cross-section in the shape of circular arc. The track or groove is constricted in width and depth to provide a reduced cross-section area at regular intervals.

Figure 19:
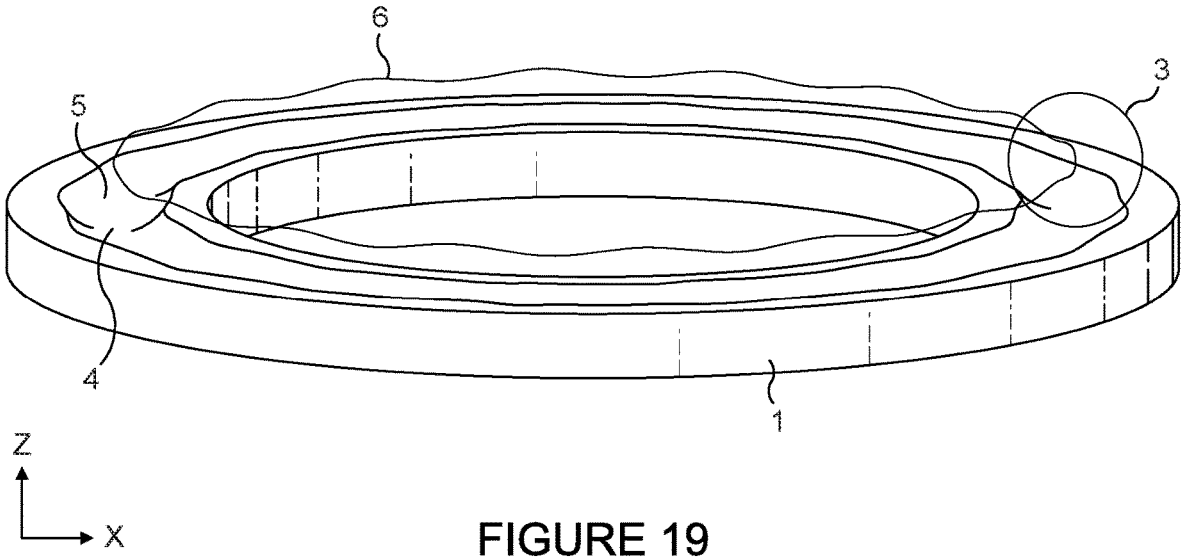

FIG. 19 shows the rotation element of FIG. 18, and in particular, the 'groovy track'. The rotation element (1), the one or more bearings (3), the raised portions (4) and the lowered portions (5) are shown. The path (6) of the centre of a ball bearing made to follow the 'groovy track' is also shown. The centre follows a sinusoidal path in the tangential/circumferential direction, with a harmonic oscillation in the axial (i.e. vertical) correction. Like FIG. 18, the track or groove has a tangential cross-section in the shape of circular arc.

Figure 20:
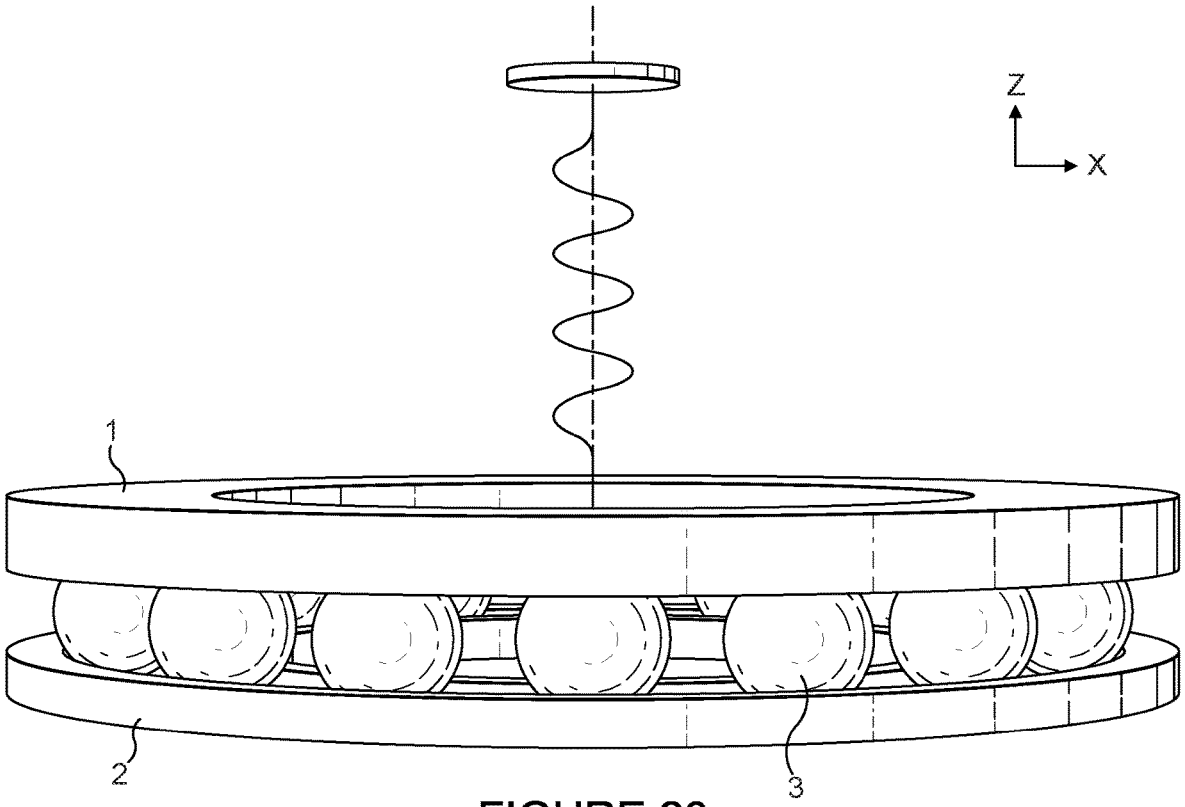

FIG. 20 shows a FE (finite element) model showing the main components with a cage having 16 balls.

Figure 21:
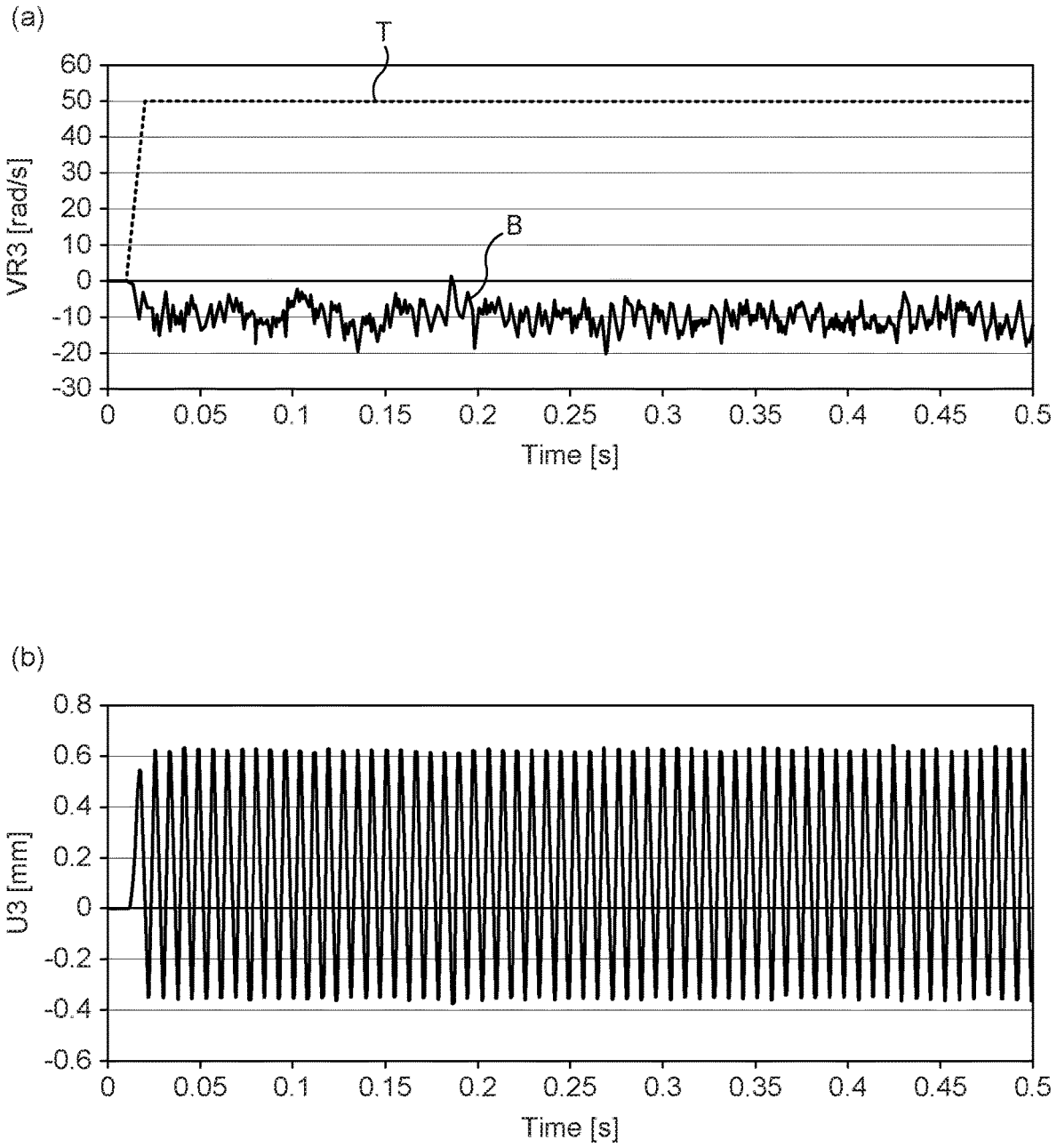

FIG. 21 shows time histories of the FE results computed for 50 rad/s; (a) angular velocity of top (upper line) and bottom (lower line) rings, (b) axial displacement of the top ring.

Figure 22:
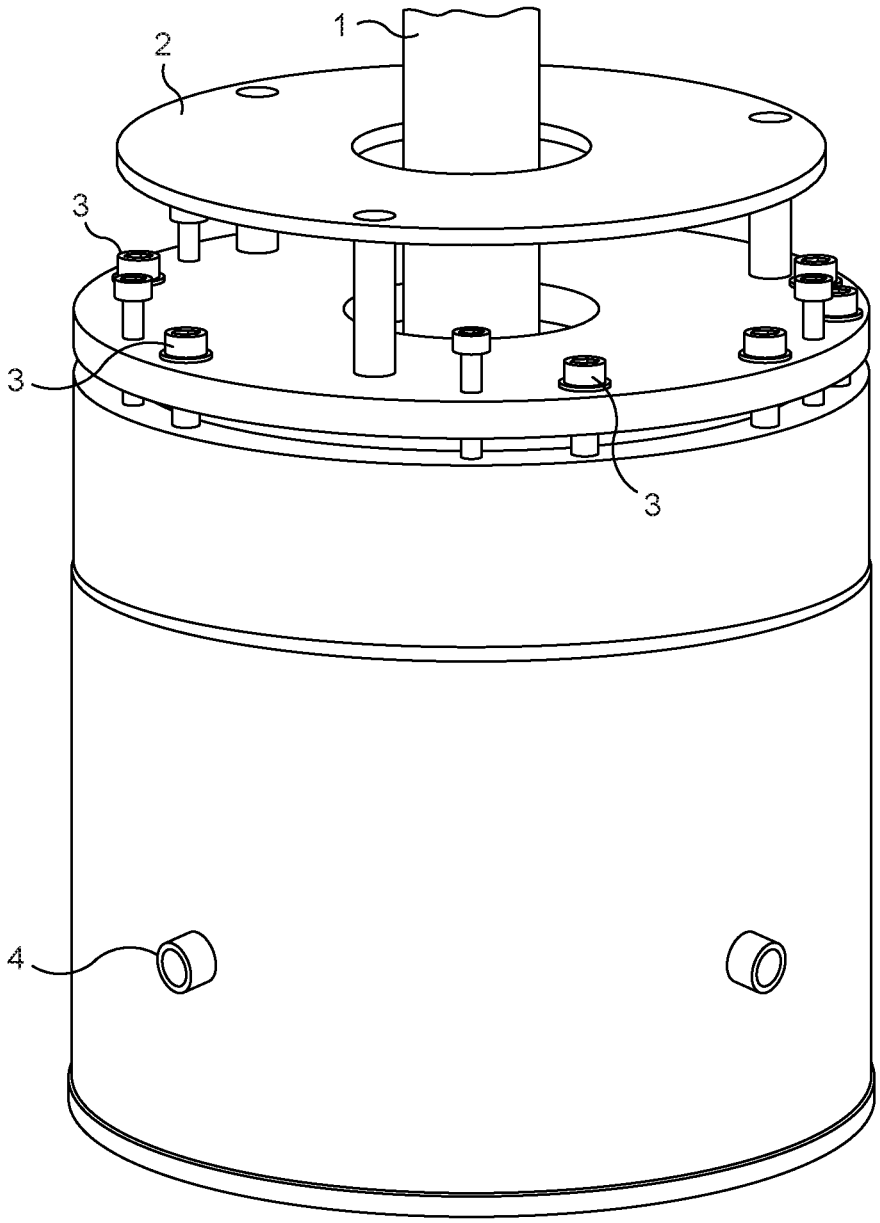

FIG. 22 shows the mechanical RED module. Shaft (1), motion collector (2), preload controller (3) and bearing fixer (4) are marked.

Figure 23:
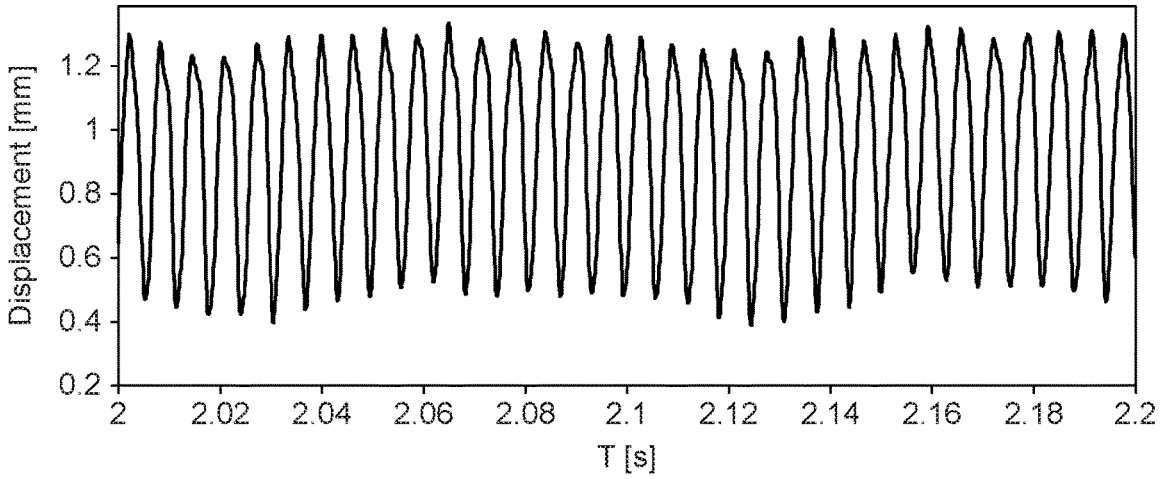

FIG. 23 shows the axial displacement of the motion collector for nominal speed of 650 RPM.

Figure 24:
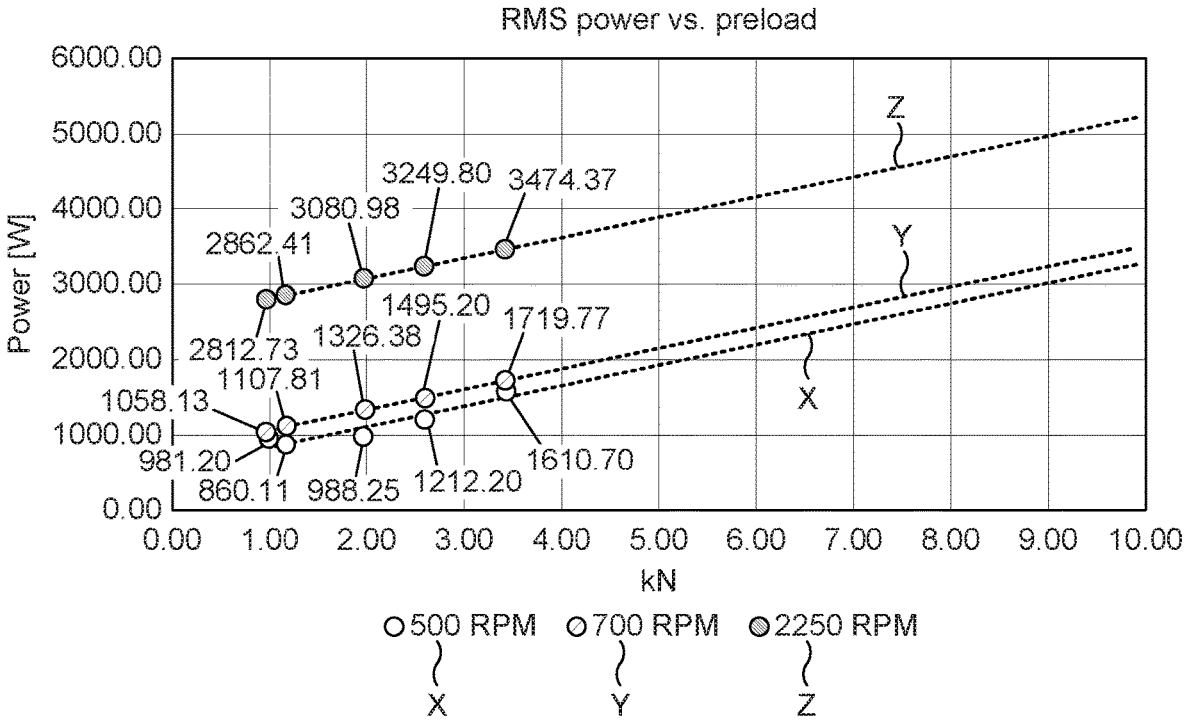

FIG. 24 shows the RMS (root-mean-square) power needed to maintain the rotation of the groovy disk for different preload as well as the linear extrapolation for higher preload. In this figure, the lower (X), middle (Y) and upper (Z) lines represent the mean torque for 500, 700 and 2250 RPM, respectively.

Figure 1:
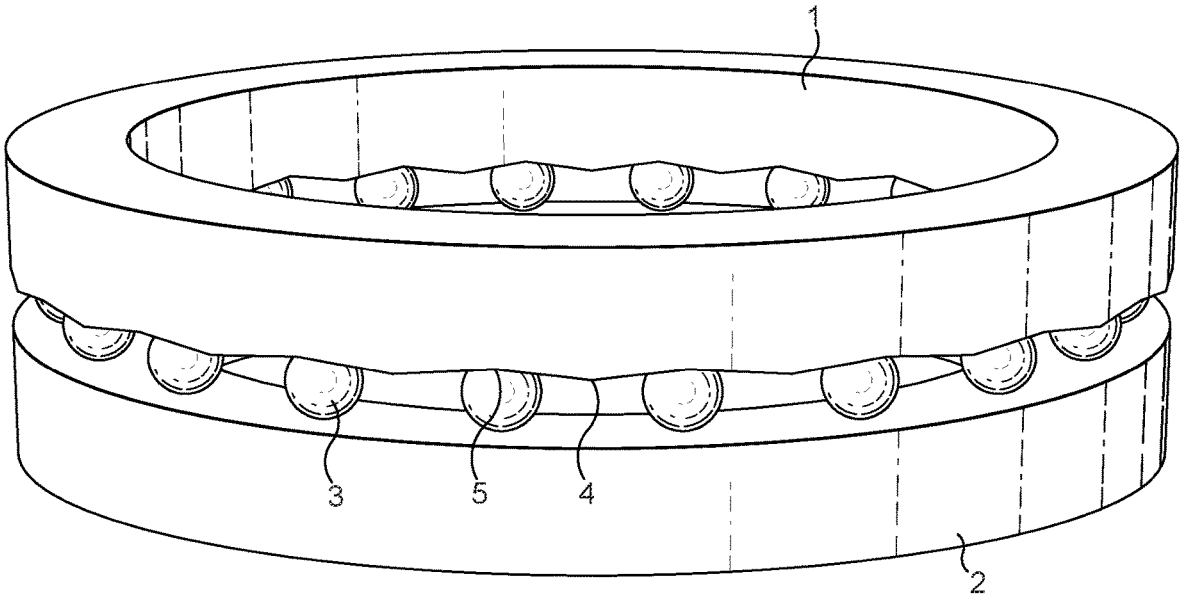
FIG. 1 shows the device of the invention, including the rotation element (1), the base element (2), the one or more bearings (3), the raised portions (4) and the lowered portions (5).
Figure 2:
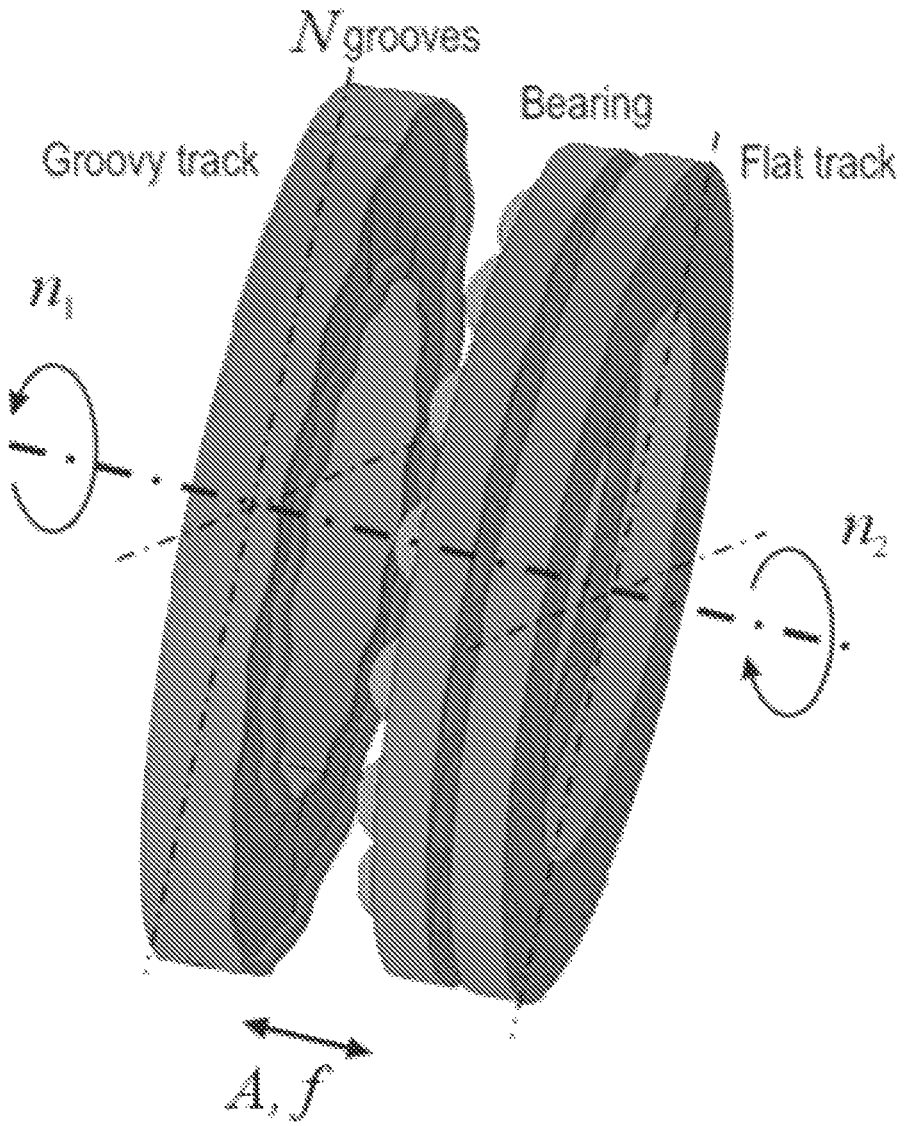
FIG. 2 shows a more detailed view of the actuator of the invention, with raised and lowered portions being present as a "groovy track" set into the rotation element and the base element being flat ("flat track").

As has been mentioned, the device operates by transforming rotary motion into axial motion. It employs a kinematic mechanism, which translates the relative rotary motion between the rotation element and the base element into periodic axial excitation, see FIGS. 1 and 2.

Assuming that the relative rotary speed n is the sum of the rotary speed both sides:

$$n_1+n_2$$

the excitation frequency will be a product between this sum and the number of grooves N, $$f_a=N(n_1+n_2)/60$$

if $n_1$ and $n_2$ are given in rpm.

The excitation amplitude is a half of the difference between a hill and a valley on the track set into the rotation element. It should be noted that here ball bearings are shown for illustration only and any sort of bearing arrangements including the hydrostatic and hydrodynamic can be used.

In an embodiment, the number of grooves (that is, a pair of the raised portion and/or lowered portion on the base element or the rotation element), N, may range from 3 to 100, more preferably 8 to 50, more preferably 10 to 40, more preferably 12 to 30, and more preferably 14 to 20. A preferred number of grooves N is 16. The number of the one or more bearings preferably matches the number of grooves N.

Figure 3:
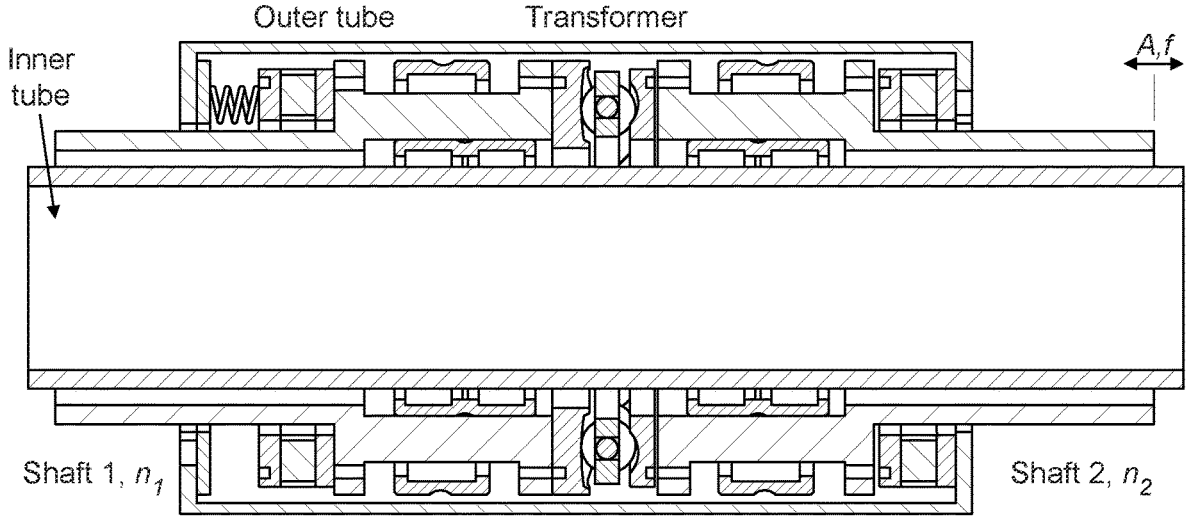
FIG. 3 shows a more detailed view of the actuator incorporated in a RED drilling module.

In FIG. 3 an exemplary design of the mechanical actuator is provided. It is comprised of inner and outer tubes. The inner tube may convey a drilling fluid; the outer tube may be the diameter of the drilling tool. The relative rotary motion between Shaft 1 and Shaft 2 is translated by the Transformer. The required axial motion with amplitude A and frequency $f_a$ can be collected from Shaft 2. One of two shafts can be driven by any one or more of the following: a standard mud motor; custom made mud motor; a mud turbine; a pneumatic motor; and an electric motor. In an embodiment the motor may comprise a clutch mechanism to vary speed and/or torque. It will be appreciated that a mud motor and mud turbine is powered by the flow an pressure provided to it from mud, or any other fluid pumped through it. The pneumatic motor is powered by compressed air or any other gas. The electric motor is powered by AC and/or DC electricity. The appropriate motor for use to power the device will depend on the particular application in question; where the apparatus is used for deep and/or subsea applications, or where the application itself is associated with the pumping of fluid downhole at high pressures, a mud motor or mud turbine may be used; where the apparatus is used for shallow applications, an electric motor may be more appropriate; and where the apparatus is used in mining applications, a pneumatic motor may be appropriate. An example of a suitable electrical motor is a frameless electric motor manufactured by Kollmorgen of Redmond, US, such as the KBM frameless series.

It will be appreciated that a particular motor may only provide a limited range of rotational speeds. Thus, for a given number raised portions and/or lowered portions, that is, of grooves N, in conjunction with said particular motor, the range of frequencies may be similarly limited. Therefore, in an embodiment, a plurality of devices may be provided, where the numbers of grooves N associated with each device are different. The plurality of devices may be installed in an apparatus such as a drilling tool, where any one of the devices may be activated at a given time. The devices may be installed in series. When a lower range of frequencies is desired, a device having a low number of grooves N may be activated, and vice versa. A device may be deactivated by preventing relative motion between the rotation element and the base element. In an embodiment, a pin or lock may be used to prevent such motion, but it will be appreciated other means may be used to stop such motion. By providing a plurality of devices in an apparatus, where the numbers of grooves N associated with each device are different, it will be appreciated that a wider range of frequencies is possible, compared to where only one device is provided.

The positioning of the upper load-cell is such that the static axial loading from the drill-string can be measured. The position of the lower load-cell is such that dynamic loading passing from the oscillator to the drill-bit can be monitored. The load-cells are connected to a controller in order to provide down-hole closed loop real time control of the oscillator.

It will be apparent that provided that electrical power is supplied downhole, the apparatus of the embodiments (arrangements) of the invention can function autonomously and adjust the rotational and/or oscillatory loading of the drill-bit in response to the current drilling conditions so as to optimize the drilling mechanism.

During a drilling operation, the rotary drill-bit is rotated and an axially oriented dynamic loading is applied to the drill-bit by the actuator to generate a crack propagation zone to aid the rotary drill-bit in cutting though material.

The device or actuator is controlled in accordance with preferred methods of the present invention. Thus, the invention further provides a method for controlling a resonance enhanced rotary drill comprising a device or actuator as defined above, the method comprising:

controlling frequency (f) of the device or actuator in the resonance enhanced rotary drill whereby the frequency (f) is maintained in the range:

$$(D^2U_s/(8000\pi Am))^{1/2} \le f \le S_f(D^2U_s/(8000\pi Am))^{1/2}$$

where D is diameter of the rotary drill-bit, $U_s$ is compressive strength of material being drilled, A is amplitude of vibration, m is vibrating mass, and $S_f$ is a scaling factor greater than 1; and controlling dynamic force ($F_d$) of the device or actuator in the resonance enhanced rotary drill whereby the dynamic force ($F_d$) is maintained in the range:

$$[(\pi/4)D^2_{eff}U_s] \le F_d \le S_{Fd}[(\pi/4)D^2_{eff}U_s]$$

where $D_{eff}$ is an effective diameter of the rotary drill-bit, $U_s$ is a compressive strength of material being drilled, and $S_{Fd}$ is a scaling factor greater than 1, wherein the frequency (f) and the dynamic force ($F_d$) of the device or actuator are controlled by monitoring signals representing the compressive strength ($U_s$) of the material being drilled and adjusting the frequency (f) and the dynamic force ($F_d$) of the device or actuator using a closed loop real-time feedback mechanism according to changes in the compressive strength ($U_s$) of the material being drilled.

The ranges for the frequency and dynamic force are based on the following analysis.

The compressive strength of the formation gives a lower bound on the necessary impact forces. The minimum required amplitude of the dynamic force has been calculated as:

$$F_d = \frac{\pi}{4} D^2_{eff} U_s.$$

$D_{eff}$ is an effective diameter of the rotary drill-bit which is the diameter D of the drill-bit scaled according to the fraction of the drill-bit which contacts the material being drilled. Thus, the effective diameter $D_{eff}$ may be defined as:

$$D_{eff} = \sqrt{S_{\text{contact}}}D,$$

where $S_{contact}$ is a scaling factor corresponding to the fraction of the drill-bit which contacts the material being drilled. For example, estimating that only 5% of the drill-bit surface is in contact with the material being drilled, an effective diameter $D_{eff}$ can be defined as:

$$D_{eff} = \sqrt{0.05}D.$$

The aforementioned calculations provide a lower bound for the dynamic force of the device or actuator. Utilizing a dynamic force greater than this lower bound generates a crack propagation zone in front of the drill-bit during operation. However, if the dynamic force is too large then the crack propagation zone will extend far from the drill-bit compromising borehole stability and reducing borehole quality. In addition, if the dynamic force imparted on the rotary drill by the device or actuator is too large then accelerated and catastrophic tool wear and/or failure may result. Accordingly, an upper bound to the dynamic force may be defined as:

$$S_{Fd}[(\pi/4)D^2_{eff}U_s]$$

where $S_{Fd}$ is a scaling factor greater than 1. In practice $S_{Fd}$ is selected according to the material being drilled so as to ensure that the crack propagation zone does not extend too far from the drill-bit compromising borehole stability and reducing borehole quality. Furthermore, $S_{Fd}$ is selected according to the robustness of the components of the rotary drill to withstand the impact forces of the device or actuator. For certain applications $S_{Fd}$ will be selected to be less than 5, preferably less than 2, more preferably less than 1.5, and most preferably less than 1.2.

Low values of $S_{Fd}$ (e.g. close to 1) will provide a very tight and controlled crack propagation zone and also increase lifetime of the drilling components at the expensive of rate of propagation. As such, low values for $S_{Fd}$ are desirable when a very stable, high quality borehole is required. On the other hand, if rate of propagation is the more important consideration then a higher value for $S_{Fd}$ may be selected.

During impacts of the device or actuator of period $\tau$, the velocity of the drill-bit of mass m changes by an amount $\Delta v$, due to the contact force F=F(t):

$$m\Delta v = \int_0^{\tau} F(t)\,dt,$$

where the contact force F(t) is assumed to be harmonic. The amplitude of force F(t) is advantageously higher than the force $F_d$ needed to break the material being drilled. Hence a lower bound to the change of impulse may be found as follows:

$$m\Delta v = \int_0^{\tau} F_d \sin\left(\frac{\pi t}{\tau}\right)dt = \frac{1}{2}U_s 0.05 D^2 \tau.$$

Assuming that the drill-bit performs a harmonic motion between impacts, the maximum velocity of the drill-bit is $v_m = A\omega$, where A is the amplitude of the vibration, and $\omega = 2\pi f$ is its angular frequency. Assuming that the impact occurs when the drill-bit has maximum velocity $v_m$, and that the drill-bit stops during the impact, then $\Delta v = v_m = 2A\pi f$. Accordingly, the vibrating mass is expressed as $$m = \frac{0.05 D^2 U_s \tau}{4\pi f A}.$$

This expression contains τ, the period of the impact. The duration of the impact is determined by many factors, including the material properties of the formation and the tool, the frequency of impacts, and other parameters. For simplicity, τ is estimated to be 1% of the time period of the vibration, that is, $\tau = 0.01/f$. This leads to a lower estimation of the frequency that can provide enough impulse for the impacts:

$$f = \sqrt{\frac{D^2 U_s}{8000\pi A m}}.$$

The necessary minimum frequency is proportional to the inverse square root of the vibration amplitude and the mass of the bit.

The aforementioned calculations provide a lower bound for the frequency of the device or actuator. As with the dynamic force parameter, utilizing a frequency greater than this lower bound generates a crack propagation zone in front of the drill-bit during operation. However, if the frequency is too large then the crack propagation zone will extend far from the drill-bit compromising borehole stability and reducing borehole quality. In addition, if the frequency is too large then accelerated and catastrophic tool wear and/or failure may result. Accordingly, an upper bound to the frequency may be defined as:

$$S_f(D^2 U_s/(8000\pi A m))^{1/2}$$

where $S_f$ is a scaling factor greater than 1. Similar considerations to those discussed above in relation to $S_{Fd}$ apply to the selection of $S_f$. Thus, for certain applications $S_f$ will be selected to be less than 5, preferably less than 2, more preferably less than 1.5, and most preferably less than 1.2.

In addition to the aforementioned considerations for operational frequency of the device or actuator, it is advantageous that the frequency is maintained in a range which approaches, but does not exceed, peak resonance conditions for the material being drilled. That is, the frequency is advantageously high enough to be approaching peak resonance for the drill-bit in contact with the material being drilled while being low enough to ensure that the frequency does not exceed that of the peak resonance conditions which would lead to a dramatic drop off in amplitude. Accordingly, $S_f$ is advantageously selected whereby:

$$f_r/S_r \le f \le f_r$$

where $f_r$ is a frequency corresponding to peak resonance conditions for the material being drilled and $S_r$ is a scaling factor greater than 1.

Similar considerations to those discussed above in relation to $S_{Fd}$ and $S_f$ apply to the selection of $S_r$. For certain applications $S_r$ will be selected to be less than 2, preferably less than 1.5, more preferably less than 1.2. High values of $S_r$ allow lower frequencies to be utilized which can result in a smaller crack propagation zone and a lower rate of propagation. Lower values of $S_r$ (i.e. close to 1) will constrain the frequency to a range close to the peak resonance conditions which can result in a larger crack propagation zone and a higher rate of propagation. However, if the crack propagation zone becomes too large then this may compromise borehole stability and reduce borehole quality.

One problem with drilling through materials having varied resonance characteristics is that a change in the resonance characteristics could result in the operational frequency suddenly exceeding the peak resonance conditions which would lead to a dramatic drop off in amplitude. To solve this problem it may be appropriate to select $S_f$ whereby:

$$f \le (f_r - X)$$

where X is a safety factor ensuring that the frequency (f) does not exceed that of peak resonance conditions at a transition between two different materials being drilled. In such an arrangement, the frequency may be controlled so as to be maintained within a range defined by:

$$f_r/S_r \le f \le (f_r - X)$$

where the safety factor X ensures that the frequency is far enough from peak resonance conditions to avoid the operational frequency suddenly exceeding that of the peak resonance conditions on a transition from one material type to another which would lead to a dramatic drop off in amplitude.

Similarly a safety factor may be introduced for the dynamic force. For example, if a large dynamic force is being applied for a material having a large compressive strength and then a transition occurs to a material having a much lower compressive strength, this may lead to the dynamic force suddenly being much too large resulting in the crack propagation zone extend far from the drill-bit compromising borehole stability and reducing borehole quality at material transitions. To solve this problem it may be appropriate to operate within the following dynamic force range:

$$F_d \le S_{Fd}[(\pi/4)D^2_{eff} U_s - Y]$$

where Y is a safety factor ensuring that the dynamic force ($F_d$) does not exceed a limit causing catastrophic extension of cracks at a transition between two different materials being drilled. The safety factor Y ensures that the dynamic force is not too high that if a sudden transition occurs to a material which has a low compressive strength then this will not lead to catastrophic extension of the crack propagation zone compromising borehole stability.

The safety factors X and/or Y may be set according to predicted variations in material type and the speed with which the frequency and dynamic force can be changed when a change in material type is detected. That is, one or both of X and Y are preferably adjustable according to predicted variations in the compressive strength ($U_s$) of the material being drilled and speed with which the frequency (f) and dynamic force ($F_d$) can be changed when a change in the compressive strength ($U_s$) of the material being drilled is detected. Typical ranges for X include: $X>f_r/100$; $X>f_r/50$; or $X>f_r/10$. Typical ranges for Y include: $Y>S_{Fd}[(\pi/4)D^2_{eff}U_s]/100$; $Y>S_{Fd}[(\pi/4)D^2_{eff}U_s]/50$; or $Y>S_{Fd}[\pi/4)D^2_{eff}U_s]/10$.

Embodiments which utilize these safety factors may be seen as a compromise between working at optimal operational conditions for each material of a composite strata structure and providing a smooth transition at interfaces between each layer of material to maintain borehole stability at interfaces.

The previously described embodiments of the present invention are applicable to any size of drill or material to be drilled. Certain more specific embodiments are directed at drilling through rock formations, particularly those of variable composition, which may be encountered in deep-hole drilling applications in the oil, gas and mining industries. The question remains as to what numerical values are suitable for drilling through such rock formations.

The compressive strength of rock formations has a large variation, from around $U_s$=70 MPa for sandstone up to $U_s$=230 MPa for granite. In large scale drilling applications such as in the oil industry, drill-bit diameters range from 90 to 800 mm (3½ to 32"). If only approximately 5% of the drill-bit surface is in contact with the rock formation then the lowest value for required dynamic force is calculated to be approximately 20 kN (using a 90 mm drill-bit through sandstone). Similarly, the largest value for required dynamic force is calculated to be approximately 6000 kN (using an 800 mm drill-bit through granite). As such, for drilling through rock formations the dynamic force is preferably controlled to be maintained within the range 20 to 6000 kN depending on the diameter of the drill-bit. As a large amount of power will be consumed to drive a device or actuator with a dynamic force of 6000 kN it may be advantageous to utilize the invention with a mid-to-small diameter drill-bit for many applications. For example, drill-bit diameters of 90 to 400 mm result in an operational range of 20 to 1500 kN. Further narrowing the drill-bit diameter range gives preferred ranges for the dynamic force of 20 to 1000 kN, more preferably 20 to 500 kN, more preferably still 20 to 300 kN.

A lower estimate for the necessary displacement amplitude of vibration is to have a markedly larger vibration than displacements from random small scale tip bounces due to inhomogeneities in the rock formation. As such the amplitude of vibration is advantageously at least 1 mm. Accordingly, the amplitude of vibration of the device or actuator may be maintained within the range 1 to 10 mm, more preferably 1 to 5 mm.

For large scale drilling equipment the vibrating mass may be of the order of 10 to 1000 kg. The feasible frequency range for such large scale drilling equipment does not stretch higher than a few hundred Hertz. As such, by selecting suitable values for the drill-bit diameter, vibrating mass and amplitude of vibration within the previously described limits, the frequency (f) of the device or actuator can be controlled to be maintained in the range 100 to 500 Hz while providing sufficient dynamic force to create a crack propagation zone for a range of different rock types and being sufficiently high frequency to achieve a resonance effect.

FIGS. 8(*a*) and (*b*) show graphs illustrating necessary minimum frequency as a function of vibration amplitude for a drill-bit having a diameter of 150 mm. Graph (a) is for a vibrational mass m=10 kg whereas graph (b) is for a vibrational mass m=30 kg. The lower curves are valid for weaker rock formations while the upper curves are for rock with high compressive strength. As can be seen from the graphs, an operational frequency of 100 to 500 Hz in the area above the curves will provide a sufficiently high frequency to generate a crack propagation zone in all rock types using a vibrational amplitude in the range 1 to 10 mm (0.1 to 1 cm).

FIG. 9 shows a graph illustrating maximum applicable frequency as a function of vibration amplitude for various vibrational masses given a fixed power supply. The graph is calculated for a power supply of 30 kW which can be generated down hole by a mud motor or turbine used to drive the rotary motion of the drill-bit. The upper curve is for a vibrating mass of 10 kg whereas the lower curve is for a vibrating mass of 50 kg. As can be seen from the graph, the frequency range of 100 to 500 Hz is accessible for a vibrational amplitude in the range 1 to 10 mm (0.1 to 1 cm).

Figure 4:
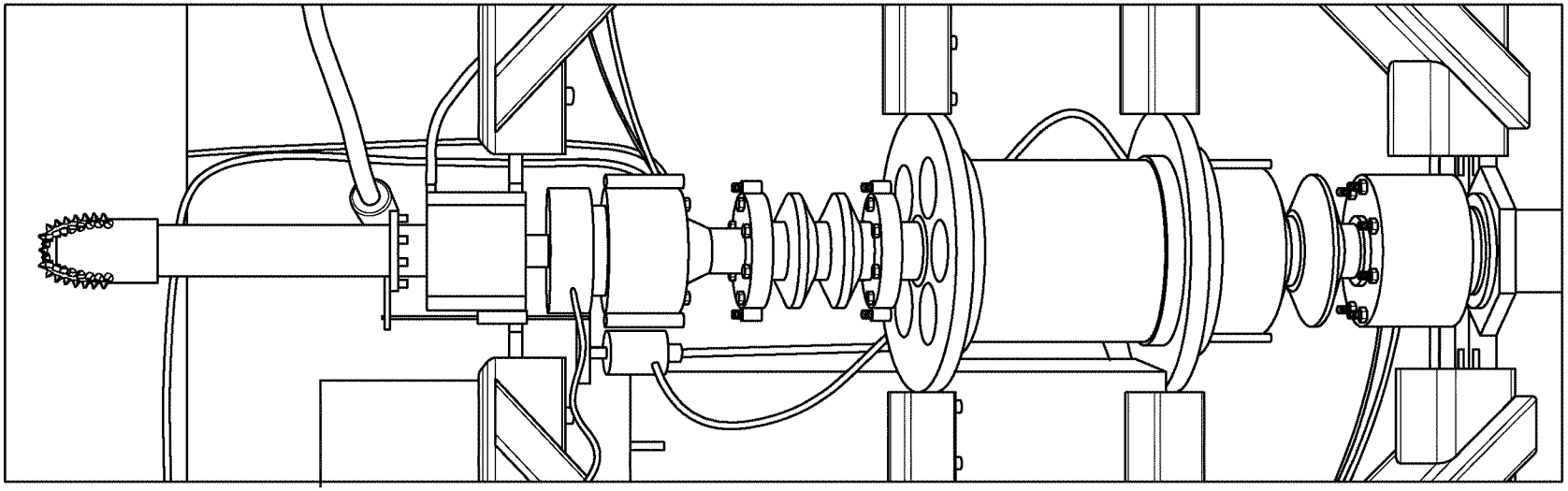
FIG. 4 and FIG. 5 depict a photograph and a schematic of the resonance enhanced drilling (RED) module according to the invention.
Figure 5:
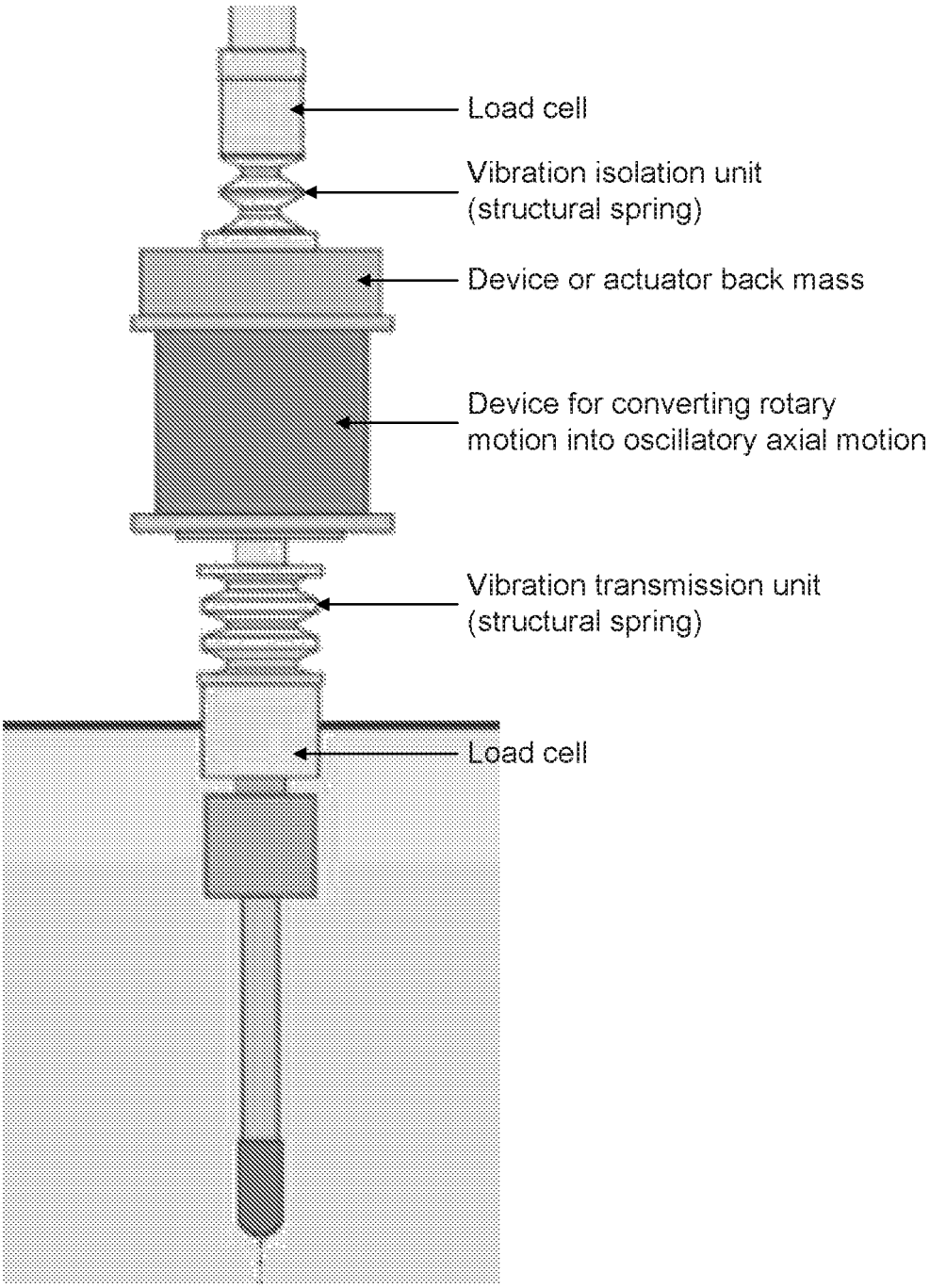
Figure 6:
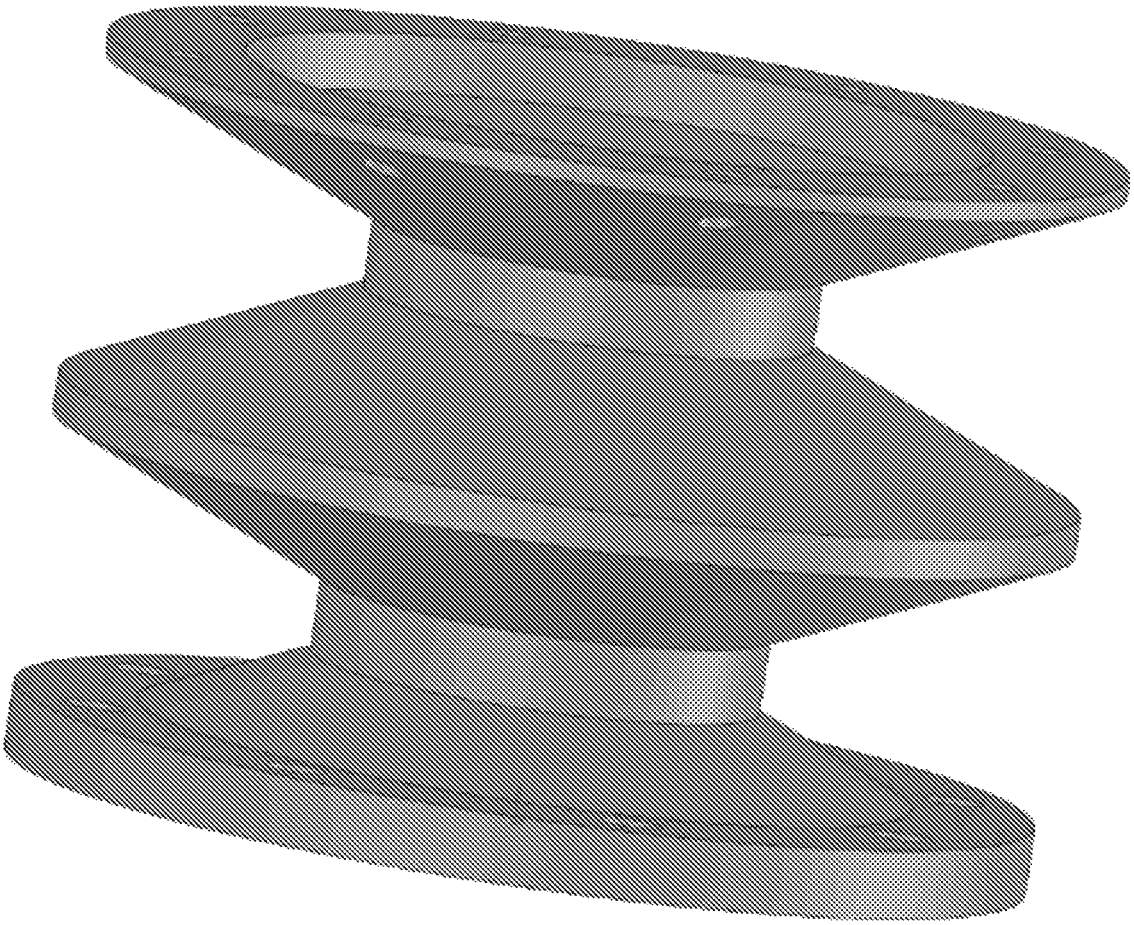
FIG. 6 depicts a schematic of a vibration isolation unit which may be used in the present invention.
Figure 7:
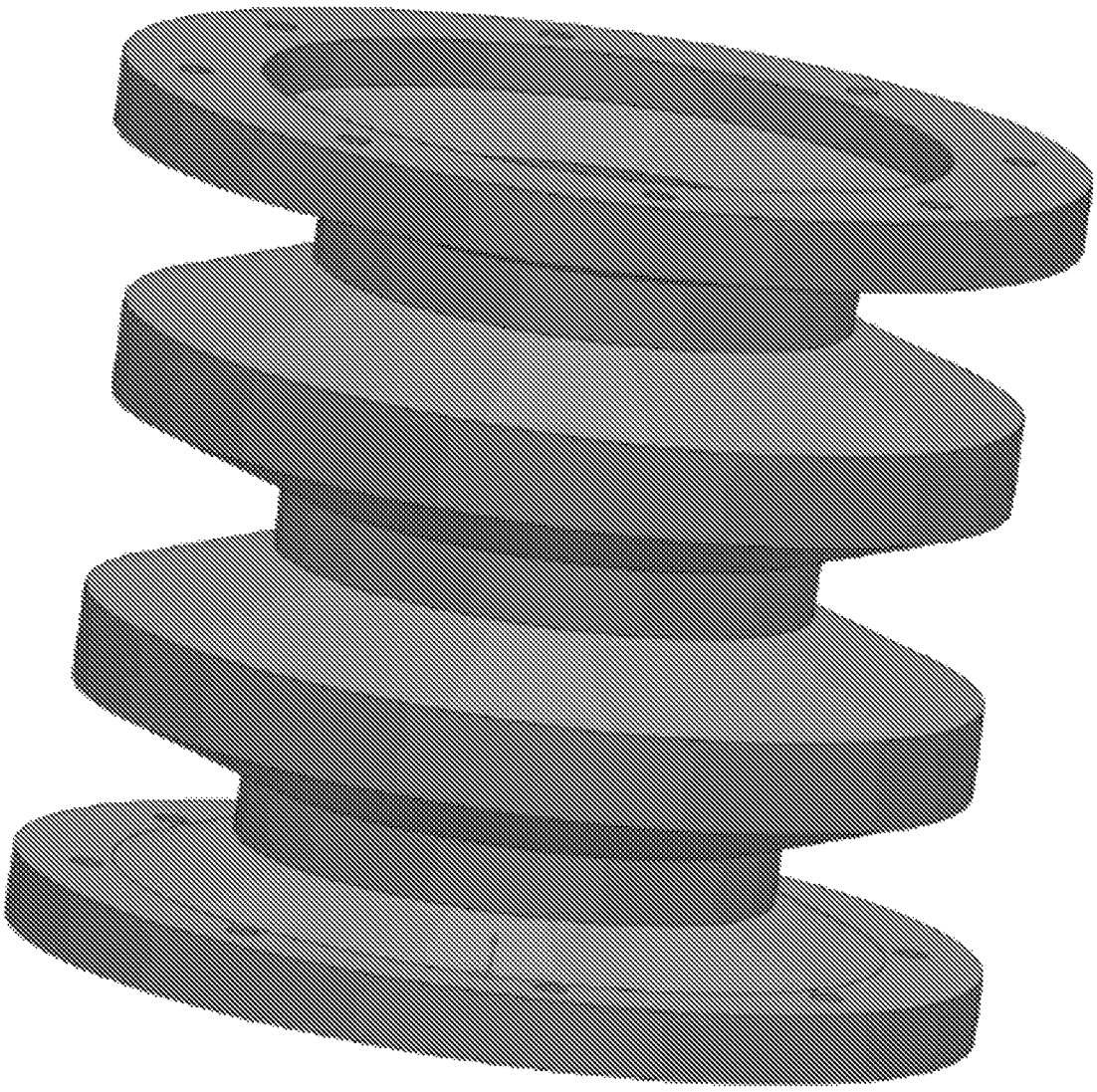
FIG. 7 depicts a schematic of a vibration transmission unit which may be used in the present invention.

A controller may be configured to perform the previously described method and incorporated into a resonance enhanced rotary drilling module such as those of the embodiments of the invention, in FIGS. 4-5. The resonance enhanced rotary drilling module is provided with sensors (e.g. load cells) which monitor the compressive strength of the material being drilled, either directly or indirectly, and provide signals to the controller which are representative of the compressive strength of the material being drilled. The controller is configured to receive the signals from the sensors and adjust the frequency (f) and the dynamic force ($F_d$) of the device or actuator using a closed loop real-time feedback mechanism according to changes in the compressive strength ($U_s$) of the material being drilled.

The inventors have determined that, the best arrangement for providing feedback control is to locate all the sensing, processing and control elements of the feedback mechanism within a down hole assembly. This arrangement is the most compact, provides faster feedback and a speedier response to changes in resonance conditions, and also allows drill heads to be manufactured with the necessary feedback control integrated therein such that the drill heads can be retro fitted to existing drill strings without requiring the whole of the drilling system to be replaced.

The device, actuator and apparatus of the invention are particularly suited to this downhole configuration, where a high pressure wet environment is typical. Such an environment has proven to be difficult to adapt to when employing magnetostrictive actuators and the like. In contrast, the mechanical actuator of the invention has proven readily adaptable to such conditions.

FIG. 10 shows a schematic diagram illustrating a downhole closed loop real-time feedback mechanism. One or more sensors 40 are provided to monitor the frequency and amplitude of an actuator 42. A processor 44 is arranged to receive signals from the one or more sensors 40 and send one or more output signals to the controller 46 for controlling frequency and amplitude of the actuator 42. A power source 48 is connected to the feedback loop. The power source 48 may be a mud motor or turbine configured to generate electricity for the feedback loop. In the figure, the power source is shown as being connected to the controller of the actuator for providing variable power to the actuator depending on the signals received from the processor. However, the power source could be connected to any one or more of the components in the feedback loop. Low power components such as the sensors and processor may have their own power supply in the form of a battery.

It is a further aim of the present invention to provide an improved steering system for use in directional drilling, and resonance enhanced directional drilling, which systems and methods provide greater steering accuracy and control than known methods and systems, whilst improving reliability and reducing cost by avoiding heavy and complex equipment.

Thus, in a further aspect, the present invention provides an apparatus for use in directional drilling, which apparatus is as defined in any of the above, and additionally comprises:

(a) at least one steering actuator capable of exerting a longitudinal force on the apparatus, so as to change the direction of drilling; and/or (b) at least one drill bit steering insert, capable of extending and retracting so as to change the cutting characteristics of the drill bit and thereby change the direction of drilling.

In the context of this aspect of the present invention, 'directional drilling' means any type of drilling in which the direction of drilling can be changed such that the resulting bore hole (specifically the axis of the bore hole) is not a straight line. This includes any and all types of directional drilling currently known in the art.

Also in the context of this aspect of the present invention, 'longitudinal' means: in a direction substantially parallel to the axis of the apparatus itself; and/or substantially parallel to the axis of rotation of the apparatus, the drill assembly, or the drill bit; and/or substantially parallel to the axis of the bore hole in the region where the steering actuator is located.

In operation, one or more steering actuators are turned on, so that the longitudinal force is exerted on one side of the apparatus preferentially. This in turn will expand (or contract) the apparatus preferentially on one side, thus 'bending' the apparatus sufficiently to turn the drill bit through a small angle. This deformation will continue until the steering actuator(s) are turned off. In the 'bent' configuration, the apparatus will drill through a curved trajectory, determined by the degree of bend created by the actuator(s). Thus, the curvature of the trajectory can be controlled by exerting greater or lesser force through the actuator(s) (i.e. creating greater or lesser 'bend' in the apparatus) and the direction may be controlled by selecting one or more actuators on one side of the apparatus so that the force acts asymmetrically to create the required 'bend' in a chosen direction.

Alternatively (or in addition) one or more drill bit steering inserts are operated so that they are extended from the face of the drill bit for a portion of the drill bit rotation, and refracted during the remaining part of the rotation. Thus, the extension occurs only within a chosen angle of rotation of the drill bit, such that the insert will contact only a chosen portion of the rock face that is in contact with the drill bit. In this way, the rock face is drilled preferentially at the chosen point of contact with the insert. The drill assembly and bore hole then turns in the direction of the preferential drilling.

The advantage of both of these systems is that they allow a steering in any direction without fitting special tools and without complicated mud motors. Moreover, they both allow much finer control, and can bit switched off as easily and quickly as they are switched on, allowing straight drilling to resume. Access to a full 3-dimensional space downhole becomes possible, in a cost effective and efficient manner. Electronic feedback mechanisms and computer control technology can assist the apparatus in achieving the high degree of precision control that is possible using this system.

The present invention further provides a method of drilling comprising operating an apparatus as defined above. Typically, the present method comprises operating one or more of the steering actuators to thereby cause a desired change in direction of drilling, and/or operating one or more of the steering inserts to thereby cause a desired change in direction of drilling.

The principles of the present invention may be best understood by reference to the following examples. It is to be noted, however that the examples do not limit the invention in any way. The scope of the present invention is limited only by the claims which follow, and within whose scope the invention may be modified.

EXAMPLE

Mechanical Exciter—Proof of Concept

In order to perform a validation of the concept, an FE (finite element) model was constructed. The model has four main components, a top ring with sinusoidal groves [rotation element (1)], a cage with balls [one or more bearings (3)], a bottom ring (standard bearing ring) [base element (2)] and a compressive spring to hold these three components together. This is shown in FIG. 20, where 16 balls were used. FIG. 21 shows the time histories of the FE results computed for 50 rad/s. 21(*a*) depicts the angular velocity of the top ring [black, upper line (T)], which was set to 50 rad/s and the computed angular velocity of the bottom ring [blue, lower line (B)].

The axial displacement of the top ring is shown in FIG. 21(*b*). This example clearly proves the concept of the mechanical exciter and its capabilities to transform rotational motion into axial movement.

Experimental Results

A prototype of the mechanical exciter as shown in FIG. 22 was built and several experiments were carried out. The shaft (1), motion collector (2), preload controller (3) and bearing fixer (4) are marked. The mechanical exciter is driven by a motor and a force transducer is placed inside of the module to provide the preload. Eddy current probes are located close to the motion collector to measure its displacement. A 4D dynamometer is placed underneath of the exciter to mainly measure the reaction torque. The data is collected from these sensors through DAQ (data acquisition) system and then noise filtering and smoothing data are applied.

An experimental time history of the axial displacement of the motion collector of a nominal speed of 650 RPM is shown in FIG. 23. The frequency of excitation generated by the mechanical exciter is evaluated via FFT (Fast Fourier Transform) of the measured axial displacement and it is fairly close to the expected value calculated from the rpm of the shaft and number of balls, i.e. 619/60*16=165 Hz. Table 1 lists nominal rotary speeds, measured frequencies of the axial motion, rotary speeds, peak-to-peak displacements, preload and peak-to-peak of measured force for series of experiments with a 3 kN preload. FIG. 24 depicts the RMS (root-mean-square) power needed to maintain the rotation of the groovy disk for different preload as well as the linear extrapolation for higher preload. In this figure, the lower (X), middle (Y) and upper (Z) lines represent the mean torque for 500, 700 and 2250 RPM, respectively.

TABLE 1

Experimental results of test of the mechanical Transducer with a 3 kN preload.

| Nominal Rotary Speed [RPM] | Frequency [Hz] | Calculated Rotary speed [RPM] | peak-to-peak displacement [mm] | Preload [kN] | peak-to-peak measured Force [kN] |
|---|---|---|---|---|---|
| 60 | 16.25 | 60.94 | 0.84 | 3.06 | 3.36 |
| 140 | 38.37 | 143.89 | 0.90 | 3.19 | 3.48 |
| 212 | 57.45 | 215.43 | 0.92 | 3.14 | 3.33 |
| 340 | 89.34 | 335.03 | 0.95 | 3.44 | 3.44 |
| 515 | 141.68 | 531.29 | 1.04 | 3.29 | 3.28 |
| 650 | 169.22 | 634.58 | 1.07 | 3.21 | 3.03 |

While this invention has been particularly shown and described with reference to preferred embodiments, it will be understood to those skilled in the art that various changes in form and detail may be made without departing from the scope of the invention as defined by the appending claims.

The invention claimed is:

1. A device for converting rotary motion into oscillatory axial motion, which device comprises:

(a) a rotation element (1);

(b) a base element (2); and (c) one or more bearings (3) for facilitating rotary motion of the rotation element relative to the base element;

wherein the rotation element and/or the base element comprise one or more raised portions (4) and/or one or more lowered portions (5) over which portions the one or more bearings (3) pass in order to periodically increase and decrease axial distance between the rotation element (1) and the base element (2) as rotation occurs, thereby imparting an oscillatory axial motion to the rotation element (1) relative to the base element (2), wherein the one or more bearings is a rolling-element bearing;

wherein the raised and/or lowered portions are in the form of a track or groove set into the rotation element and/or into the base element, wherein the track or groove is configured to constrain the one or more bearings, and the track or groove has a tangential cross-section in the shape of a circular arc.

2. The device according to claim 1, wherein the raised and or lowered portions are in the form of indentations and/or protuberances set into the rotation element and/or into the base element, wherein the indentations and/or protuberances are in the form of ridges and troughs running radially out from the axis of rotation of the rotation element and/or of the base element.

3. The device according to claim 1, wherein the raised and or lowered portions are in the form of smooth changes in the thickness of the rotation element and/or of the base element.

4. The device according to claim 1, further comprising a spring to urge the rotation element and the base element together.

5. A device according to claim 1, wherein the rolling-element bearing is a ball bearing or a barrel bearing.

6. An actuator for use in a resonance enhanced drilling module comprising a device as defined in claim 1.

7. An actuator for use in a resonance enhanced drilling module, comprising a first device and a second device according to claim 1:

said first device having a first number of bearings, and said second device having a second number of bearings, wherein the first number and the second number are not the same.

8. An apparatus for use in resonance enhanced rotary drilling, which apparatus comprises a device of claim 1.

9. The apparatus according to claim 8, which apparatus comprises a drilling module comprising a drill-bit, wherein the apparatus further comprises:

a sensor for measuring one or more parameters relating to the interaction of the drill-bit and the material being drilled; and a sensor for measuring one or more motions of the drill-bit.

10. The apparatus according to claim 9, wherein the one or more parameters relating to the interaction of the drill-bit and the material being drilled comprise one or more impact characteristics of the drill-bit with the material being drilled, and/or one or more forces between the drill bit and the material being drilled, which apparatus comprises:

an accelerometer for measuring the one or more impact characteristics of the drill-bit with the material being drilled, a load cell for measuring the one or more forces between the drill-bit and the material being drilled, or an eddy current sensor for measuring one or more motions of the drill-bit.

11. The apparatus according to claim 9, wherein the drilling module further comprises a control system for controlling one or more drilling parameters of the drilling module, wherein the control system employs information from the sensors to control the drilling parameters, wherein the control system comprises:

(a) a controller for determining one or more characteristics of the material to be drilled, and (b) a controller for determining one or more drilling parameters to apply to the drilling module;

and wherein one or more of the controllers employs information from one or more of the sensors.

12. The apparatus according to claim 9, wherein the sensors are capable of measuring one or more of the following drilling parameters:

(a) axial drill force on the material being drilled (also called "weight on bit" (WOB), or "static force")

(b) velocity or speed of the drill-bit and/or drilling module (also known as the "rate of progression" (ROP));

(c) the acceleration of the drill-bit and/or drilling module;

(d) the frequency of oscillation of the drill-bit and/or drilling module;

(e) the amplitude of oscillation of the drill-bit and/or drilling module;

(f) the oscillatory axial drill force on the material being drilled (also called the "dynamic force");

(g) the rotary velocity or rotary speed of the drill;

(h) the rotary force or torque of the drill;

(i) fluid flow rate; and (j) relative displacement of the drill-bit.

13. The apparatus according to claim 9, wherein the frequency (f) of the device is controlled to be maintained in the range 100 Hz and above, preferably from 100 to 500 Hz, or the dynamic force ($F_d$) is controlled to be maintained within the range up to 1000 kN, more preferably 40 to 500 kN, more preferably still 50 to 300 kN.

14. An apparatus comprising:

(i) a sensor for measuring static loading or for monitoring the compressive strength of the material being drilled;

(ii) a vibration isolation unit;

(iii) a device for applying axial oscillatory loading to a rotary drill-bit;

(iv) a sensor for measuring dynamic axial loading or for monitoring the compressive strength of the material being drilled;

(v) a drill-bit connector; and (vi) a rotary drill-bit, wherein the sensor (i) is preferably positioned above the vibration isolation unit and the sensor (iv) is preferably positioned between the device (iii) and the drill-bit connector (v) wherein the sensors are connected to a controller in order to provide down-hole closed loop real time control of the device (iii), and wherein the device is for converting rotary motion into oscillatory axial motion, which device comprises:

(a) a rotation element (1);

(b) a base element (2); and (c) one or more bearings (3) for facilitating rotary motion of the rotation element relative to the base element;

wherein the rotation element and/or the base element comprise one or more raised portions (4) and/or one or more lowered portions (5) over which portions the one or more bearings (3) pass in order to periodically increase and decrease axial distance between the rotation element (1) and the base element (2) as rotation occurs, thereby imparting an oscillatory axial motion to the rotation element (1) relative to the base element (2).

15. The apparatus according to claim 14, further comprising a vibration transmission unit between the device (iii) and sensor (iv).

16. The apparatus according to claim 14, wherein the frequency (f) and the dynamic force ($F_d$) of the device are capable of being controlled by the controller.

17. The apparatus according to claim 14 for use in directional drilling, which apparatus comprises:

(a) at least one steering actuator capable of exerting a longitudinal force on the drill bit, so as to change the direction of drilling; and/or (b) at least one drill bit steering insert, capable of extending and retracting so as to change the cutting characteristics of the drill bit and thereby change the direction of drilling.

18. The apparatus according to claim 14, wherein the one or more bearings is a ball bearing or a barrel bearing.

19. A method of drilling comprising operating an apparatus as defined in claim 14.

20. The method of drilling according to claim 19, the method comprising:

controlling frequency (f) of the apparatus whereby the frequency (f) is maintained in the range:

$$(D^2U_s/(8000\pi Am))^{1/2} \leq f \leq S_f(D^2U_s/(8000\tau Am))^{1/2}$$

where D is diameter of a rotary drill-bit, $U_s$ is compressive strength of material being drilled, A is amplitude of vibration, m is vibrating mass, and $S_f$ is a scaling factor greater than 1; and controlling dynamic force ($F_d$) of the apparatus whereby the dynamic force ($F_d$) is maintained in the range:

$$[(\pi/4)D^2_{eff}U_s] \leq F_d \leq S_{Fd}[(\pi/4)D^2_{eff}U_s]$$

where $D_{eff}$ is an effective diameter of the rotary drill-bit, $U_s$ is a compressive strength of material being drilled, and $S_{Fd}$ is a scaling factor greater than 1, wherein the frequency (f) and the dynamic force ($F_d$) of the apparatus are controlled by monitoring signals representing the compressive strength ($U_s$) of the material being drilled and adjusting the frequency (f) and the dynamic force ($F_d$) of the apparatus using a closed loop real-time feedback mechanism according to changes in the compressive strength ($U_s$) of the material being drilled.

21. The method according to claim 20, wherein $S_f$ is less than 5, or $S_{Fd}$ is less than 5.

22. The method according to claim 20, wherein $S_f$ is selected whereby:

$$f \leq f_r$$

where $f_r$ is a frequency corresponding to peak resonance conditions for the material being drilled, wherein $S_f$ is selected whereby:

$$f \leq (f_r - X)$$

where X is a safety factor ensuring that the frequency (f) does not exceed that of peak resonance conditions at a transition between two different materials being drilled, wherein $X > f_r/100$, or wherein:

$$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled, wherein $Y > S_{Fd}[(\pi/4)D^2_{eff}U_s]/100$.

23. The method according to claim 19, wherein the method further comprises controlling the amplitude of vibration of the device to be maintained within the range 0.5 to 10 mm, the frequency (f) of the device is in the range 100 Hz and above or the dynamic force ($F_d$) is controlled to be maintained within the range up to 1000 kN.

24. A method of controlling a resonance enhanced rotary drill comprising an apparatus as defined in claim 14, the method comprising:

(a) employing one or more initial characteristics of the material being drilled, and/or one or more initial drilling parameters to control the drilling module;

(b) measuring one or more current drilling parameters using the sensors to obtain one or more measured drilling parameters;

(c) employing the one or more measured drilling parameters to calculate one or more characteristics of the material being drilled;

(d) employing the one or more calculated characteristics of the material being drilled, and/or the one or more measured drilling parameters, to calculate one or more calculated drilling parameters;

(e) optionally applying the one or more calculated drilling parameters to the drilling module;

(f) optionally repeating steps (b), (c) (d) and (e).

25. The method according to claim 24, wherein in step (d) one or more calculated drilling parameters from a previous iteration of the control process are employed as further input to determine the calculated drilling parameters.

26. The method according to claim 24, wherein the drilling parameters comprise one or more of the following:

(a) axial drill force on the material being drilled (also called "weight on bit" (WOB), or "static force")

(b) velocity or speed of the drill-bit and/or drilling module through the material being drilled;

(c) the acceleration of the drill-bit and/or drilling module through the material being drilled;

(d) the frequency of oscillation of the drill-bit and/or drilling module;

(e) the amplitude of oscillation of the drill-bit and/or drilling module;

(f) the oscillatory axial drill force on the material being drilled (also called the "dynamic force");
(g) the rotary velocity or rotary speed of the drill;
(h) the rotary force or torque of the drill on the material being drilled;
(i) fluid flow rate; and
(j) relative displacement of the drill-bit, or wherein the characteristics of the material being drilled comprise one or more of:
(a) the compressive strength of the material
(b) the stiffness or the effective stiffness of the material;
(c) the yield strength of the material;
(d) the impact strength of the material;
(e) the fatigue strength of the material;
(f) the tensile strength of the material;
(g) the shear strength of the material;
(h) the hardness of the material;
(i) the density of the material;
(j) the Young's modulus of the material; and
(k) the Poisson's ratio of the material.

* * * * *